US010488041B2

(12) United States Patent
Usci et al.

(10) Patent No.: US 10,488,041 B2
(45) Date of Patent: Nov. 26, 2019

(54) GAS DOMESTIC PREMIXED VENTILATED HOB

(71) Applicant: TRE P ENGINEERING S.R.L., Chiaravalle (IT)

(72) Inventors: Rosalino Usci, Jesi (IT); Michele Marcantoni, Polverigi (IT)

(73) Assignee: TRE P ENGINEERING S.R.L., Chiaravalle (IT)

( * ) Notice: Subject to any disclaimer, the term of this patent is extended or adjusted under 35 U.S.C. 154(b) by 226 days.

(21) Appl. No.: 15/556,147

(22) PCT Filed: Mar. 9, 2016

(86) PCT No.: PCT/IB2016/000269
§ 371 (c)(1),
(2) Date: Sep. 6, 2017

(87) PCT Pub. No.: WO2016/142770
PCT Pub. Date: Sep. 15, 2016

(65) Prior Publication Data

US 2018/0274781 A1 Sep. 27, 2018

(30) Foreign Application Priority Data

Mar. 11, 2015 (IT) ..... AN2015A0041

(51) Int. Cl.
*F23N 1/02* (2006.01)
*F24C 3/08* (2006.01)
(Continued)

(52) U.S. Cl.
CPC ..... *F23N 1/022* (2013.01); *F23D 14/64* (2013.01); *F24C 3/085* (2013.01); *F24C 3/126* (2013.01);
(Continued)

(58) Field of Classification Search
CPC .. F23N 1/022; F23N 2037/02; F23N 2033/06; F23D 14/64; F24C 3/126; F24C 3/085
See application file for complete search history.

(56) References Cited

U.S. PATENT DOCUMENTS 3,606,612 A 9/1971 Reid
4,083,355 A 4/1978 Schwank
(Continued)

FOREIGN PATENT DOCUMENTS

GB 2419183 A 4/2006
JP S59136817 A 8/1984
(Continued)

OTHER PUBLICATIONS

International Search Report, issued in WO 2016/142770, dated Sep. 30, 2016.

*Primary Examiner* — David J Laux
(74) *Attorney, Agent, or Firm* — Locke Lord LLP; Nicholas J. DiCeglie, Jr.

(57) ABSTRACT

The object of the present invention is a ventilated hob (400) comprising a motor-driven fan (V) adapted to provide high pressure air to two or more burners (BRNi) thereof, each of said two or more burners (BRNi) at least comprising means (VG, 211; 211.*a*, 211.*b*) for supplying and regulating the flow of fuel gas ($Q_{GAS}$) in input into each of said two or more burners (BRNi), means (VP; 101; UG) for supplying the flow of combustion air ($Q_{AIR}$) in input into each of said two or more burners (BRNi), able to mix with said fuel gas, shut-off valves of the flow of said combustion air, an electronic unit ($_{CMD}$) for controlling said air flow ($Q_{AIR}$). The air flow ($Q_{AIR}$) varies as a function of said flow of fuel gas ($Q_{GAS}$) in input into each of said two or more burners (BRNi) so as to ensure a gas-air mixture with a stoichiometric or substantially stoichiometric ratio without the need of input of secondary air from the outside, said variation of
(Continued)

air flow ($Q_{AIR}$) being obtained by varying the pressure of the combustion air in said sealed circuit (CA1, 405, 407) inside said hob (400).

Said pressure is intermediate to the single pressures that each active burner (BRNi) should have.

18 Claims, 19 Drawing Sheets

(51) Int. Cl.
*F24C 3/12* (2006.01)
*F23D 14/64* (2006.01)

(52) U.S. Cl.
CPC ..... *F23N 2033/06* (2013.01); *F23N 2037/02* (2013.01)

(56) References Cited

U.S. PATENT DOCUMENTS

| | | | | |
|---|---|---|---|---|
| 4,645,450 | A * | 2/1987 | West | F23N 1/022 1/22 |
| 5,325,842 | A * | 7/1994 | Beach | F24C 3/126 126/21 R |
| 6,076,517 | A * | 6/2000 | Kahlke | F23D 14/64 126/39 E |
| 9,028,245 | B2 * | 5/2015 | Fan | F23N 1/022 1/22 |
| 2007/0202451 | A1 | 8/2007 | Lee et al. | |
| 2014/0130723 | A1 * | 5/2014 | Conrads | F23K 3/02 110/347 |

FOREIGN PATENT DOCUMENTS

| | | | |
|---|---|---|---|
| JP | S62261817 | A | 11/1987 |
| WO | 2005/064234 | A1 | 7/2005 |

* cited by examiner

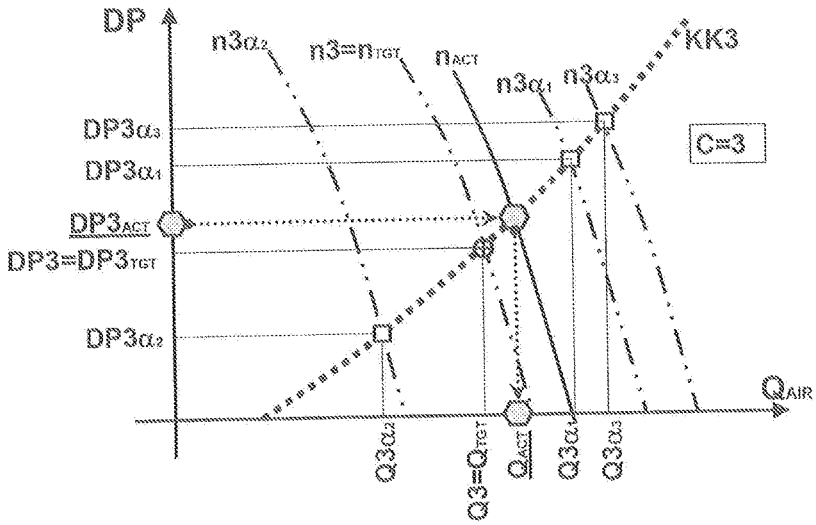

Fig. 20

| C | BRN 1 | BRN 2 | BRN 3 | BRN 4 | KK [Pa]*[(m^3/s)^2] | DP [Pa] | n [rpm] |
|---|---|---|---|---|---|---|---|
| 0 | 0 | 0 | 0 | 0 | 0 | 0 | 0 |
| 1 | 0 | 0 | 0 | 1 | KK1 | DP1 | n1 |
| 2 | 0 | 0 | 1 | 0 | KK2 | DP2 | n2 |
| 3 | 0 | 0 | 1 | 1 | KK3 | DP3 | n3 |
| *** | *** | | | | *** | *** | *** |
| 14 | 1 | 1 | 1 | 0 | KK14 | DP14 | n14 |
| 15 | 1 | 1 | 1 | 1 | KK15 | DP15 | n15 |

(a)

| αi∈ | inf | sup | C | BRN 4 DA4_H | BRN 4 DA4_L | BRN 3 DA3_H | BRN 3 DA3_L | BRN 2 DA2_H | BRN 2 DA2_L | BRN 1 DA1_H | BRN 1 DA1_L | KK [Pa]*[(m^3/s)^2] | DP [Pa] | n [rpm] |
|---|---|---|---|---|---|---|---|---|---|---|---|---|---|---|
| *** | *** | *** | 0 | 0 | 0 | 0 | 0 | 0 | 0 | 0 | 0 | 0 | 0 | 0 |
| α1 | α1_min | α1_Low | 1 | 0 | 0 | 0 | 0 | 0 | 0 | 0 | 1 | KK1 | DP1 | n1 |
| α1 | α1_Low | α1_Med | 2 | 0 | 0 | 0 | 0 | 0 | 0 | 1 | 0 | KK2 | DP2 | n2 |
| α1 | α1_Med | α1_MAX | 3 | 0 | 0 | 0 | 0 | 0 | 0 | 1 | 1 | KK3 | DP3 | n3 |
| α2 | α2_min | α2_Low | 4 | 0 | 0 | 0 | 0 | 0 | 1 | 0 | 0 | KK4 | DP4 | n4 |
| | | | 5 | 0 | 0 | 0 | 0 | 0 | 1 | 0 | 1 | KK5 | DP5 | n5 |
| | | | 6 | 0 | 0 | 0 | 0 | 0 | 1 | 1 | 0 | KK6 | DP6 | n6 |
| | | | 7 | 0 | 0 | 0 | 0 | 0 | 1 | 1 | 1 | KK7 | DP7 | n7 |
| α2 | α2_Low | α2_Med | 8 | 0 | 0 | 0 | 0 | 1 | 0 | 0 | 0 | KK8 | DP8 | n8 |
| | *** | | *** | | | | | *** | | | | *** | *** | *** |
| | | | 254 | 1 | 1 | 1 | 1 | 1 | 1 | 1 | 0 | KK254 | DP254 | n254 |
| αi | αi_Med | αi_MAX | 255 | 1 | 1 | 1 | 1 | 1 | 1 | 1 | 1 | KK255 | DP255 | n255 |

(b)

Fig. 21

| α | level | C | BRN 4 dd4_H | BRN 4 DA4_H | BRN 4 dd4_L | BRN 4 DA4_L | BRN 3 dd3_H | BRN 3 DA3_H | BRN 3 dd3_L | BRN 3 DA3_L | BRN 2 dd2_H | BRN 2 DA2_H | BRN 2 dd2_L | BRN 2 DA2_L | BRN 1 dd1_H | BRN 1 DA1_H | BRN 1 dd1_L | BRN 1 DA1_L | KK [Pa]*[(m^3/s)^2] | DP [Pa] | n [rpm] |
|---|---|---|---|---|---|---|---|---|---|---|---|---|---|---|---|---|---|---|---|---|---|
| αi | OFF | 0 | 0 | 0 | 0 | 0 | 0 | 0 | 0 | 0 | 0 | 0 | 0 | 0 | 0 | 0 | 0 | 0 | 0 | 0 | 0 |
| α1 | min | 1 | 0 | 0 | 0 | 0 | 0 | 0 | 0 | 0 | 0 | 0 | 0 | 0 | 0 | 0 | 1 | 1 | KK1 | DP1 | n1 |
| α1 | Med | 2 | 0 | 0 | 0 | 0 | 0 | 0 | 0 | 0 | 0 | 0 | 0 | 0 | 1 | 1 | 0 | 0 | KK2 | DP2 | n2 |
| α1 | MAX | 3 | 0 | 0 | 0 | 0 | 0 | 0 | 0 | 0 | 0 | 0 | 0 | 0 | 1 | 1 | 1 | 1 | KK3 | DP3 | n3 |
| α2 | min | 4 | 0 | 0 | 0 | 0 | 0 | 0 | 0 | 0 | 0 | 0 | 1 | 1 | 0 | 0 | 0 | 0 | KK4 | DP4 | n4 |
| | | 5 | 0 | 0 | 0 | 0 | 0 | 0 | 0 | 0 | 0 | 0 | 1 | 1 | 0 | 0 | 1 | 1 | KK5 | DP5 | n5 |
| | | 6 | 0 | 0 | 0 | 0 | 0 | 0 | 0 | 0 | 0 | 0 | 1 | 1 | 1 | 1 | 0 | 0 | KK6 | DP6 | n6 |
| | | 7 | 0 | 0 | 0 | 0 | 0 | 0 | 0 | 0 | 0 | 0 | 1 | 1 | 1 | 1 | 1 | 1 | KK7 | DP7 | n7 |
| α3 | Med | 8 | 0 | 0 | 0 | 0 | 0 | 0 | 0 | 0 | 1 | 1 | 0 | 0 | 0 | 0 | 0 | 0 | KK8 | DP8 | n8 |
| *** | | *** | | | | | | | | | *** | | | | | | | | *** | *** | *** |
| | | 254 | 1 | 1 | 1 | 1 | 1 | 1 | 1 | 1 | 1 | 1 | 1 | 1 | 1 | 1 | 1 | 0 | KK254 | DP254 | n254 |
| αi | MAX | 255 | 1 | 1 | 1 | 1 | 1 | 1 | 1 | 1 | 1 | 1 | 1 | 1 | 1 | 1 | 1 | 1 | KK255 | DP255 | n255 |

(c)

GAS DOMESTIC PREMIXED VENTILATED HOB

CROSS REFERENCE TO RELATED APPLICATIONS

This application is a 35 U.S.C. § 371 National Phase Application of International PCT Patent Application No. PCT/IB2016/000269, Mar. 9, 2016, which application claims the benefit of priority to Italian Patent Application No. AN2015A000041, filed Mar. 11, 2015, the contents of each of which in their entirety are hereby incorporated herein by reference.

The present invention relates to an innovative hob, household in particular, comprising multiple gas burners capable of producing an air-gas mixing with stoichiometric titre or with a slight excess of air; burners thus capable of producing fully premixed flames and possibly with excess of air.

Hobs comprising multiple atmospheric burners are known wherein the air-gas mixture is obtained by the effect of the gas supply pressure using the principle of the Venturi tube ejector and without the aid of fans.

The ejectors (see FIG. 2), are extremely simple, economical and reliable devices and it is for this reason that they are used for air-fuel gas mixing in the burners of hobs. Substantially all of the household gas hobs currently on the market use atmospheric burners.

In the Venturi tube ejector (hereinafter simply "ejector"), the pressure energy of a motor fluid available at a nozzle located at the inlet of a Venturi tube with nozzle flow $Q_m$ and nozzle pressure $P_m$, is transformed into kinetic energy; the high-velocity jet coming out from the nozzle induces and drags an induced fluid flow at lower pressure $P_i$ that flows in at a flow rate $Q_i$; both flows are conveyed within a pipe of section $A_{thr}$ (which is the Venturi groove) where they mix and recover part of the pressure; then the mixing continues in a diverging section (which is the Venturi diffuser) where additional kinetic energy is recovered in static pressure.

In this case, the pressure of the secondary $P_i$ is the atmospheric pressure $p_a$, the motor fluid with flow $Q_m$ is a fuel gas with flow $Q_{gas}$ and pressure $p_{gas}$ pressure and the induced fluid with flow $Q_i$ is the combustion air with flow $Q_a$ and pressure $p_a$; because of the very modest pressure variations that the gases are subject to while crossing the Venturi, they can be considered in incompressible condition.

The ideal length of the Venturi groove is comprised between 2 and 4 times its diameter D; the diffuser has a weak opening to recover pressure avoiding the stall (typically 2°-4° half-open). At the outlet of the diffuser, fuel gas and combustion air are, substantially fully mixed, with a flow of the mixture $Q_{mix}=Q_{GAS}Q_a$ and a pressure $p_{mix}$.

Said stoichiometric mixture is an air-gas mixture where the air and gas masses are in a mixture ratio (mixture titre) equal to the exact stoichiometric ratio STC for a complete combustion of the gas without residual oxygen. A mixture rich in gas, that is to say with a mixture ratio<STC, i.e. with lack of air, is herein referred to as "rich" mixture. A mixture poor in gas, that is to say with a mixture ratio>STC, i.e. with excess of air, is herein referred to as "lean" mixture. For a complete combustion, in practice, a mixture with a slight excess of air in required compared to the STC ratio theoretically sufficient. Hereinafter, however, by "stoichiometric" titre mixture or "STC mixture" it is meant a mixture with that minimum slight excess of air necessary to ensure the complete combustion.

Ejector efficiency $\eta_{ej}$ is herein defined as the ratio between the kinetic energy in the time unit of the mixture at the outlet of the diffuser, which is $E_{mix}=(P_{mix}-P_i)\times Q_{mix}$, and the kinetic energy at the nozzle, which is $Egas=(p_{GAS}-P_i)\times Q_{GAS}$.

That is, $\eta_{ej}=E_{mix}/E_{GAS}=[(P_{mix}-P_i)\times Q_{mix}]/[(p_{GAS}-P_i)\times Q_{GAS}]$.

The geometry of Venturi is a determining element for the efficiency $\eta_{ej}$ of the ejector.

The greater is the efficiency $\eta_{ej}$ of the ejector the greater is the combustion air flow $Q_{AIR}$ that may be induced and if this was sufficient to obtain mixtures with a slight excess of air, the ejector burner would be independent from any supply of additional air.

This is possible in principle, if there are no overall dimensions limits, by accurately sizing, as a function of the thermal power required, the diameter D and the length L20 of the Venturi groove and the length L30 and the angle of divergence $B_2$ of the diffuser.

However, for burners for hobs, in particular household hobs, which provide for nominal powers of the various gas cookers (typically in a number of 4, 5 or 6) from 600÷ 800 W to 3 kW to arrive at 5 kW in the case of "special burners", the geometrical and dimensional constraints of the hob and the operating parameters of the burners are absolutely incompatible with the ideal construction criteria for the ejectors with consequent dramatic drop of the efficiency to a very few percentage points because the induced combustion air, called "primary air", is not sufficient to obtain mixtures with STC titre that allow the complete combustion. The resulting drawbacks shall now be highlighted.

The most widespread, universally accepted and most traditional technical solution for making a gas burner BRN of a hob 400, is that with the "vertical Venturi" (see FIG. 3).

In this configuration, which can be considered the standard one, and henceforth designated as STD, the ejector is particularly inefficient mainly because of the leaks in the diffuser 115, which is radial, and the reduced longitudinal extension of the Venturi that is well far from the ideal shape and substantially coincides with the groove 114. $\eta_{ej}$ values in the range of 1% are frequent.

In substance, inside the ejector that draws primary air AIR1 a mixture too rich in fuel is obtained but still within the flammability range of the gas. The rich mixture exiting vertically from the groove 114, is conveyed through the radial diffuser 115 to the "slots" 117. From there the mixture exits with a titre that already allows the partial combustion and supplies the flames FLAME1; these recall by floating (that is, by natural circulation due to the difference in density) additional AIR2, called "secondary" essential for the completion of the chemical reaction of combustion.

The need of input of secondary air in fact limits the power density of the flame which can only be composed of a discontinuous crown of flames or there would be lack of oxygen to the inner surface of the same crown. By excessively thickening the slots 117, the flames would not develop enough surface for interacting with the secondary air, resulting in excessive production of carbon monoxide (CO), or better of an unacceptably high value of the ratio $[CO]/[CO_2]$ in the fumes.

The slots 117 are essentially few tens of radial channels made with radial incisions on the body of the "flame spreader" 116 (or holes) and closed at the top by the "cap" 118 (an actual cover); thus the base of the flames has a centrifugal radial development as, moving away from the perimeter of the burner, the various "bulbs" of the crown of flames FLAME1 deviate upward in the direction of the bottom of a pot (not shown) due to floatation.

With the same nominal power, this type of STD architecture involves at least the dimensional drawbacks that is desirable to eliminate or at least mitigate.

The distance H01 between the base of the flames FLAME1 and the bottom of the pot 404 has a minimum limit due to the need of causing secondary air to flow smoothly inside the crown of flames.

Being able to reduce this parameter means increasing the efficiency $\eta_b$ of the burner, intended as the ratio between the heat effectively transferred to the pot and the heat produced by the burner.

Also the distance H11 between the base of the flames FLAME1 and the aesthetic surface 401 of the hob (hereinafter "covering top 401"), has a minimum limit due to the need to facilitate the access of the primary air AIR1 to the ejector.

As a consequence it is not possible to reduce the distance H31=H01+H11 between the pot and the covering top as desired; the pan stand grids (not shown in the enclosed drawings) are rather distant from the underlying covering top 401 with a strong limitation of freedom of product design.

Although STD burners exist capable of drawing primary air AIR1 below the covering top 401 (with suitable construction and installation devices of the same hob) in any case, the height H11 can not fall below certain limits due to the excessive heating of the same covering top 401, caused by the presence of radial flames.

It should be noted that, if such aesthetic limitation is little felt by the user, it is only because he considers it an inherent and inevitable functional need.

It is high the vertical space H21 of the mixing chamber 113 (referred to as "cup" 113), needed to seat the nozzle 111 (which must be able to be screwed on even after the installation of the hob 400) and to ensure optimal values of the distance L01 between nozzle 111 and Venturi groove 114 and a sufficient length L21 of the Venturi groove 114 where the mixing substantially completes in the STD configuration.

High are the minimum values of the height H41 of compartment 405 underlying the covering top 401, greater than the H21 because the technical overall dimensions of the fuel gas supply pipe must be added to the nozzle 111.

In conclusion, with the STD configuration the vertical spaces are considerable and not only due to the component elements of the burner but also to the inevitable empty spaces that must be left around.

As for the modulation ratio Y obtainable from a STD burner, intended as the ratio between the maximum and minimum power that can be delivered with regular combustion, it depends on many factors, but first of all on the admissible range of speed of the mixture exiting from the slots 117. In fact, this must be comprised between a minimum speed $V_{min}$ below which there is backfire and a maximum speed $V_{max}$ above which there is the lift-off thereof. According to rules well known to the men skilled in the art, $V_{min}$ and $V_{max}$ depend on the flame front speed $V_f$ which in turn depends, among other things, also on the titre of the mixture which, in turn, as seen, is affected by the geometry of the burner. In conclusion, since the flame stability $V_f$ is indirectly determined by the gas flow $Q_{gas}$ and by the configuration of the burner, the modulation ratio Y achievable is strongly influenced by such factors.

Typically, for the STD configuration Y is comprised between 3.5 and 4.5.

For higher modulation ratios Y, "special" burners are used provided with more than one ejector that separately supplies more than one crown of concentric flames; these burners, which have special geometrical features in order to cause secondary air to flow also to the innermost crowns of flame, are in fact multiple burners although often provided with a single special regulation valve that can turn on and modulate them in sequence.

Burners BRN with horizontal or "linear" Venturi configuration, herein referred to as "LIN" (see FIG. 4) have been available on the market since a few years ago.

This configuration carries a Venturi with a completely linear development (Venturi groove 214 and diffuser 215 in axis) arranged horizontally parallel to the covering top (it should be noted that in the STD burner the diffuser 115 is instead radial). The linear diffuser 215 leads to a further mixing chamber 213 that occupies all the internal volume of the burner within which the mixing of primary air AIR1 with the fuel gas continues and completes.

This solution allows to obtain mixtures still rich compared to the stoichiometric titre, that is, with lack of air, but significantly leaner than those obtainable with the STD solution.

Accordingly, also in this case the supply of secondary air AIR2 is necessary, but in a smaller amount compared to the STD case (obviously, with the same nominal power of the burner, and thus of diameter of the injector nozzle).

The slots 217 are made with over a hundred of small holes formed directly on the cap 218 with direction inclined towards the vertical of the pot. Shorter flames FLAME2, almost vertical, with an increased power density and a crown that is circumferentially continuous and radially less extended than the STD case may be obtained. In substance, the thermal exchange towards the pot improves, the contact times of the fumes with the surface of the same pot increase and it is possible to reduce the distance between the base of the flames FLAME2 and the bottom of the pot 404 (indicated with H02 in FIG. 4).

All of these considerations result in a higher efficiency $\eta_b$ of the burner BRN.

However, not even the LIN burners are free from drawbacks.

Despite such strong adaptations, the maximum value of the modulation ratio for the LINs remains limited to Y≈3. This is due to the concurrence of two factors, both related to the combustion dynamics: the fact that the titre of the mixture obtained in the Venturi is closer to the STC titre, involves a greater flame speed $V_f$ with greater risk of backfire; at the same time, simplifying, because the flames are shorter, for the fact that the combustion completes more quickly as it needs lower input of secondary air, they are also more unstable and lift-off more easily than in the STD burner.

In a STD burner, changing the type of gas requires only changing the nozzle 111 as changing the cup 113 is either impossible for space reasons or is anyway useless because it would result in modest improvements of the efficiency $\eta_{ej}$ of the ejector. In a LIN burner, instead, in order to adapt it to all types of gases, changing the injector and flame spreader is necessary, besides varying the injector-venturi distance, because both the size of the Venturi and the morphology of the slots 217 on the cap 218 must be different for the different classes of gases or the flame would be unstable.

The solutions with linear Venturi LIN currently on the market exhibit, although in a slightly reduced form compared to the STD burners, all the limitations of a non-stoichiometric mixture (too rich) because inside the household hob, for the power required by each burner, there is not enough space for seating an ejector of optimised size to induce primary air AIR1 up to the stoichiometric titre. In any case, in addition to space limitations, the linear extension of the divergent diffuser 215 must in any case be truncated in order to be jointed to the mixing chamber 213, which in turn must be large enough to allow a complete mixing of air-gas, otherwise there would be unevenness and instability of the generated flames.

As a confirmation of the absence on the market of gas cookers with fully premix atmospheric burners, it is noted that the few examples of products with active input of combustion air, referred to as "ventilated hobs" (e.g. see the solutions described in documents EP2072900, that provides a fan for each burner of the hob, and/or EP1016823) are in fact limited to means for the input of only the secondary air in order to complete what remains a partially premixed combustion. The market is made from gas burners with partially premixed burners; so far no one has proposed the fully premixed ones.

In other fields, instead, fully premixed burners have long been known; for several years; for example, premix burners characterised by the simultaneous input, through special fans arranged in series (upstream or downstream of the same burner) to air-gas mixers connected to dosing, primary air, secondary air and excess of air valves, have been installed on boilers for room heating and/or for the production of sanitary hot water.

Without going excessively into details, such boilers, being well-known solutions to the man skilled in the art, as shown schematically in FIG. 5, provide at least one fan V that supplies mixture to burner B, and that is preceded by a mixer MX comprising a "Venturi" 12 in the groove 14 section whereof the openings 16 for the access of the fuel gas are obtained.

The groove section 14 is enclosed within a sealed chamber 17 where the gas coming from a dosing valve VD accumulates; the fan V, which draws combustion air from the Venturi 12, generates a suitable depression that allows the passage of the gas from said sealed chamber 17 to the same groove 14.

An electronic control board S manages the rotation speed of the fan V as a function of the thermal power required to the boiler and pilots the operation of the dosing valve VD.

The latter, e.g. of the pneumatic type, delivers a quantity of gas that depends on the depression in the sealed chamber 17 and the air pressure in input to the Venturi 12; therefore, it behaves as a signal "follower" keeping an output pressure of the gas constantly identical to the input pressure to the Venturi 12 regardless of the thermal power output required; the titre of the mixture is thus kept constant upon variation of the thermal power of burner B.

To achieve this result, which is responsible for a modulation ratio Y of the burner B up to 8, the dosing valve VD is equipped with several sealed chambers separated by membranes loaded by springs with preload settable from the outside by as many regulations, essential to adapt it to the various systems. FIG. 6 schematically shows said dosing valve VD that therefore appears constructively extremely complicated and with large overall dimensions; e.g., see the comparison with the sizes of the mixer MX.

If compared to the construction simplicity of the STD and LIN burners, the solutions adopted in the field of premix boilers therefore appear of very difficult application to household hobs; they are in fact characterised by:

- large overall dimensions incompatible with the aesthetics of household hobs
- excessive costs, attributable to the need of using a complex mixing valve and a fan, necessarily managed by a high performance electronic control board.

The main object of the present invention is to provide a hob, household in particular, comprising more new concept burners that eliminates, at least in part, the drawbacks listed above.

More precisely, the object of the present invention is to provide hobs comprising active devices for moving the combustion air so as to produce flames fully premixed and/or with excess of air to the burners.

Even more in particular, the object of the present invention is to obtain, in said burners of said hob, a substantially stoichiometric air-gas mixture as defined above and which does not require input of external secondary air above the flame.

A further object, at least of some variants of the present invention, is to obtain modulation ratios Y higher than those possible today for hobs comprising STD or LIN burners.

A further object, at least of some variants of the present invention, is to reduce the distance necessary today between the base of the flames and the bottom of the overlying pot.

Further features and advantages of the present invention shall be better highlighted by the following description of a ventilated hob comprising multiple burners in accordance with the main claims, articulated in possible variants in accordance with the dependent claims and illustrated, by way of a non-limiting example, with the aid of the annexed drawing tables, wherein:

Figures 5, 6:
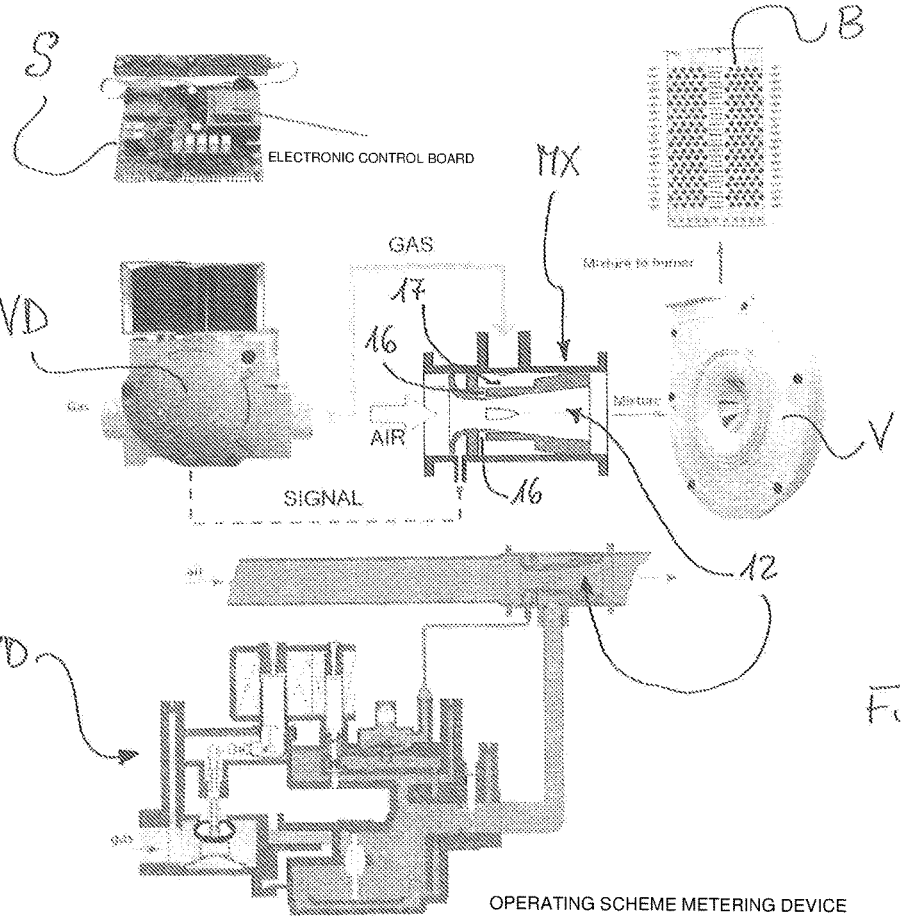
Figure 7:
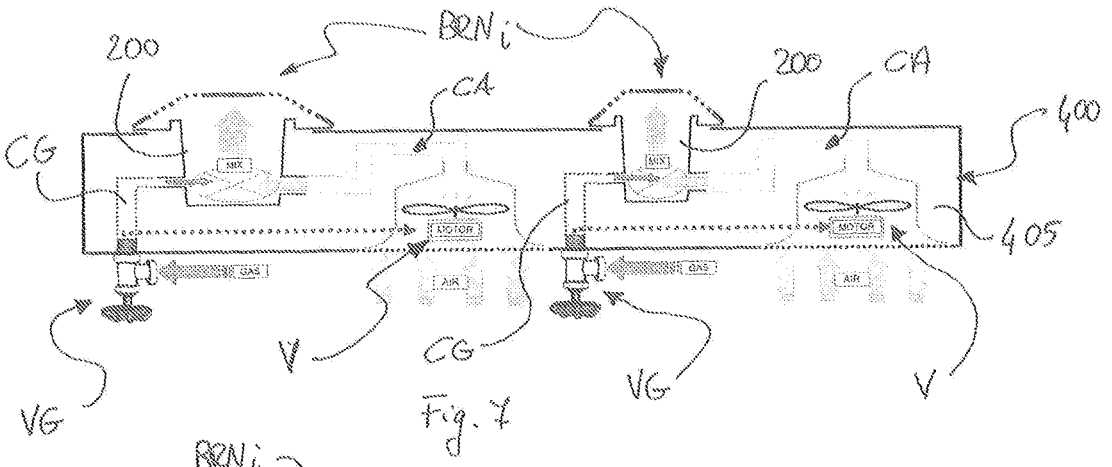
Figure 8:
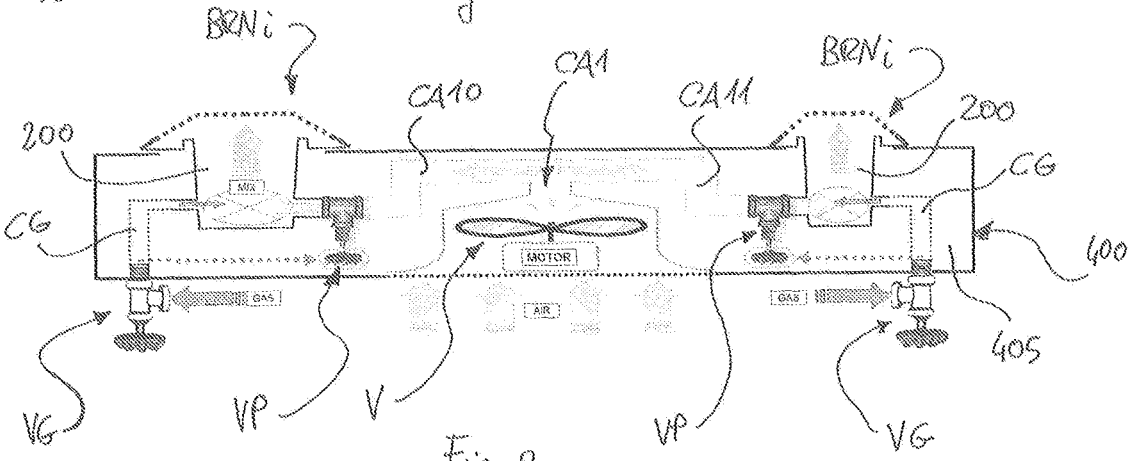
Figure 9:
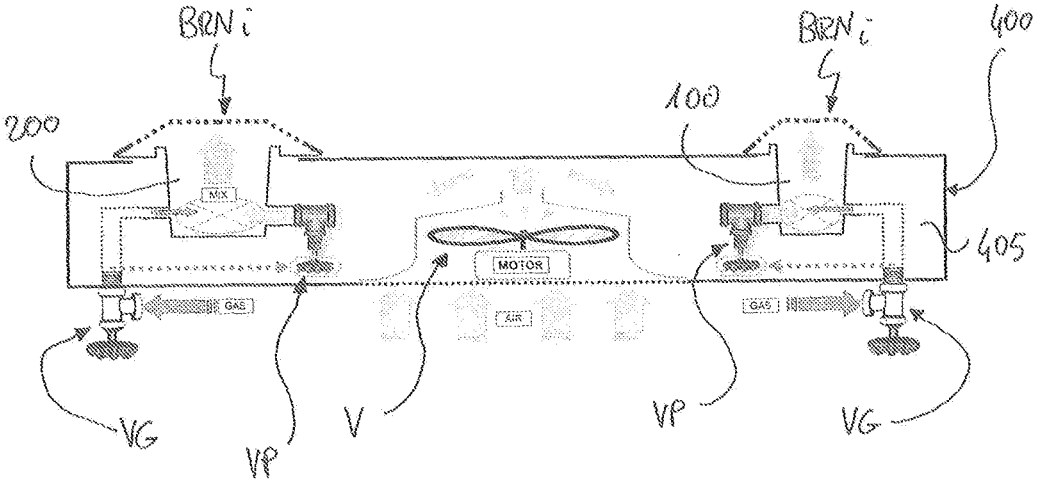
Figure 10:
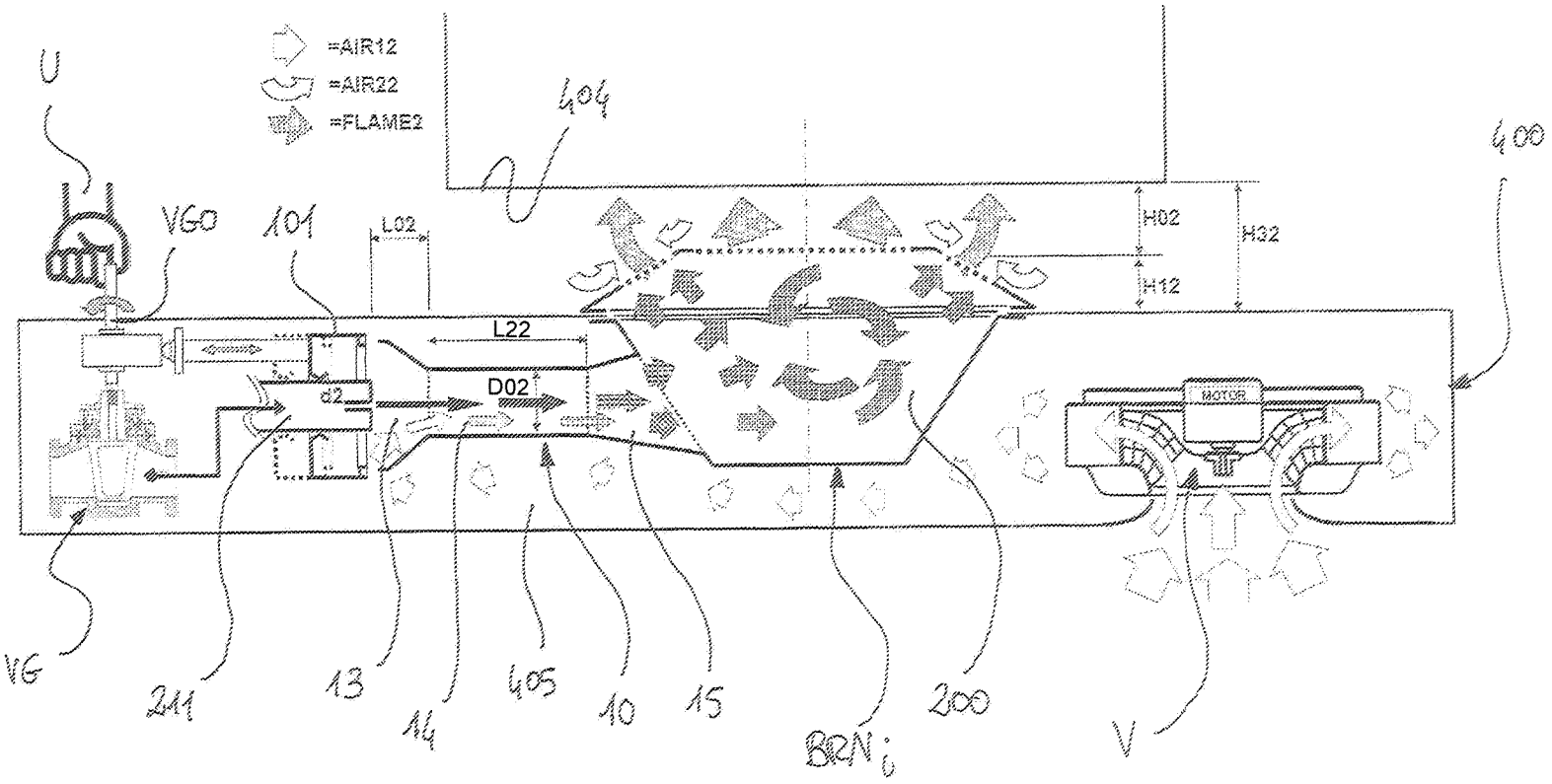
Figure 13:
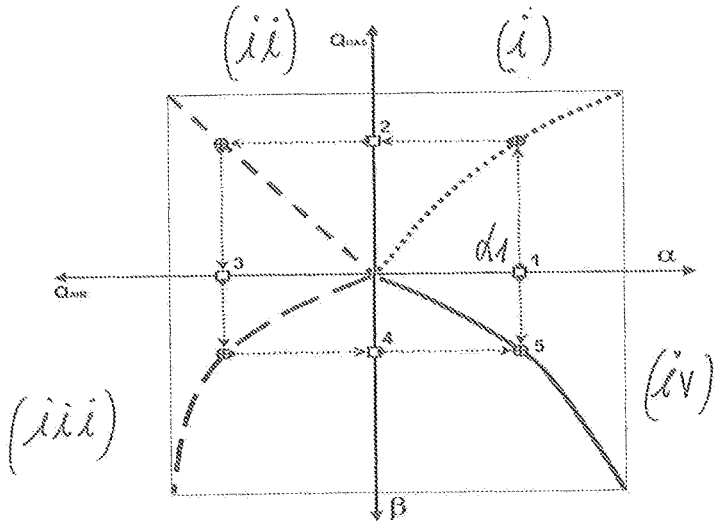
Figure 12:
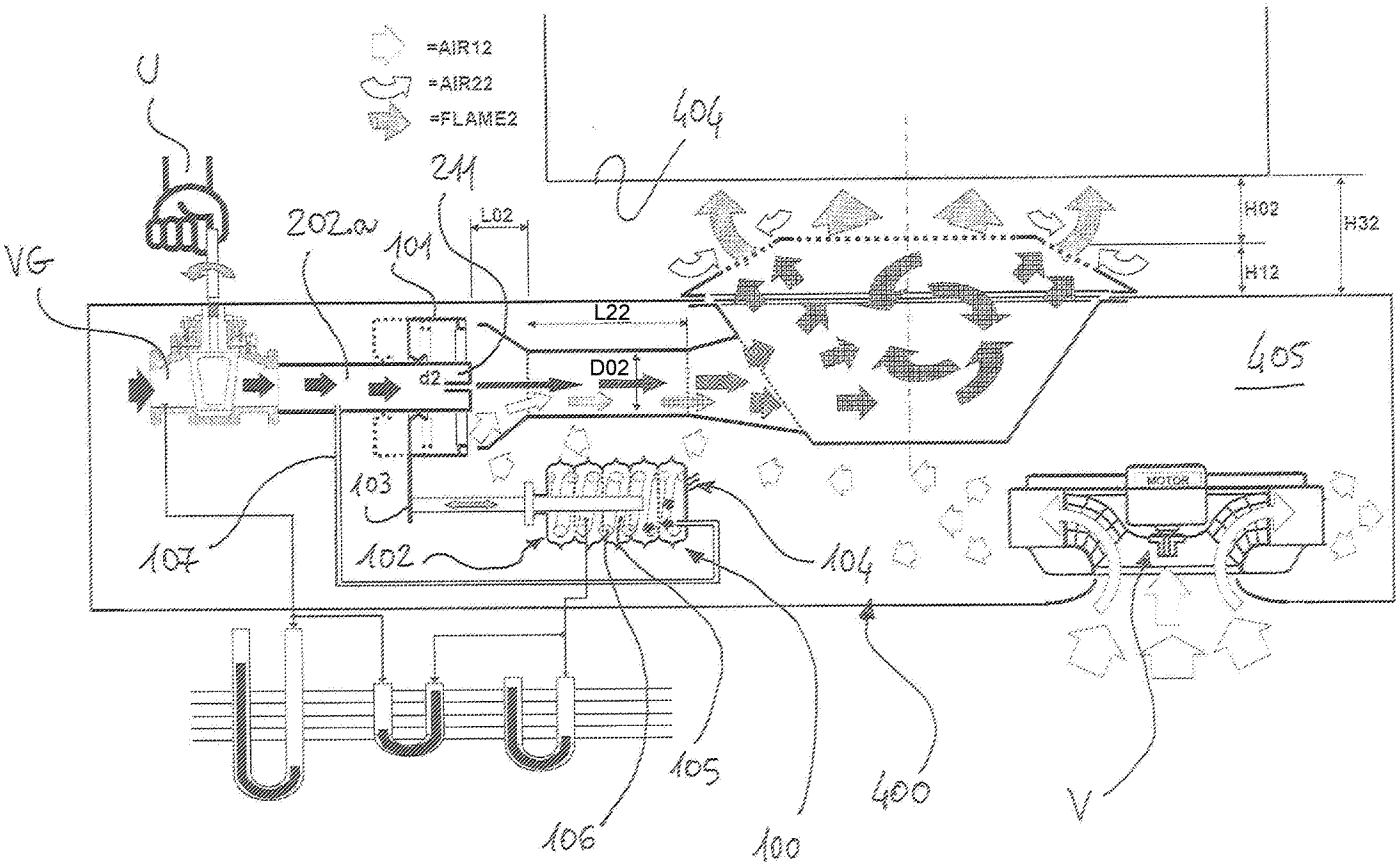
Figure 14:
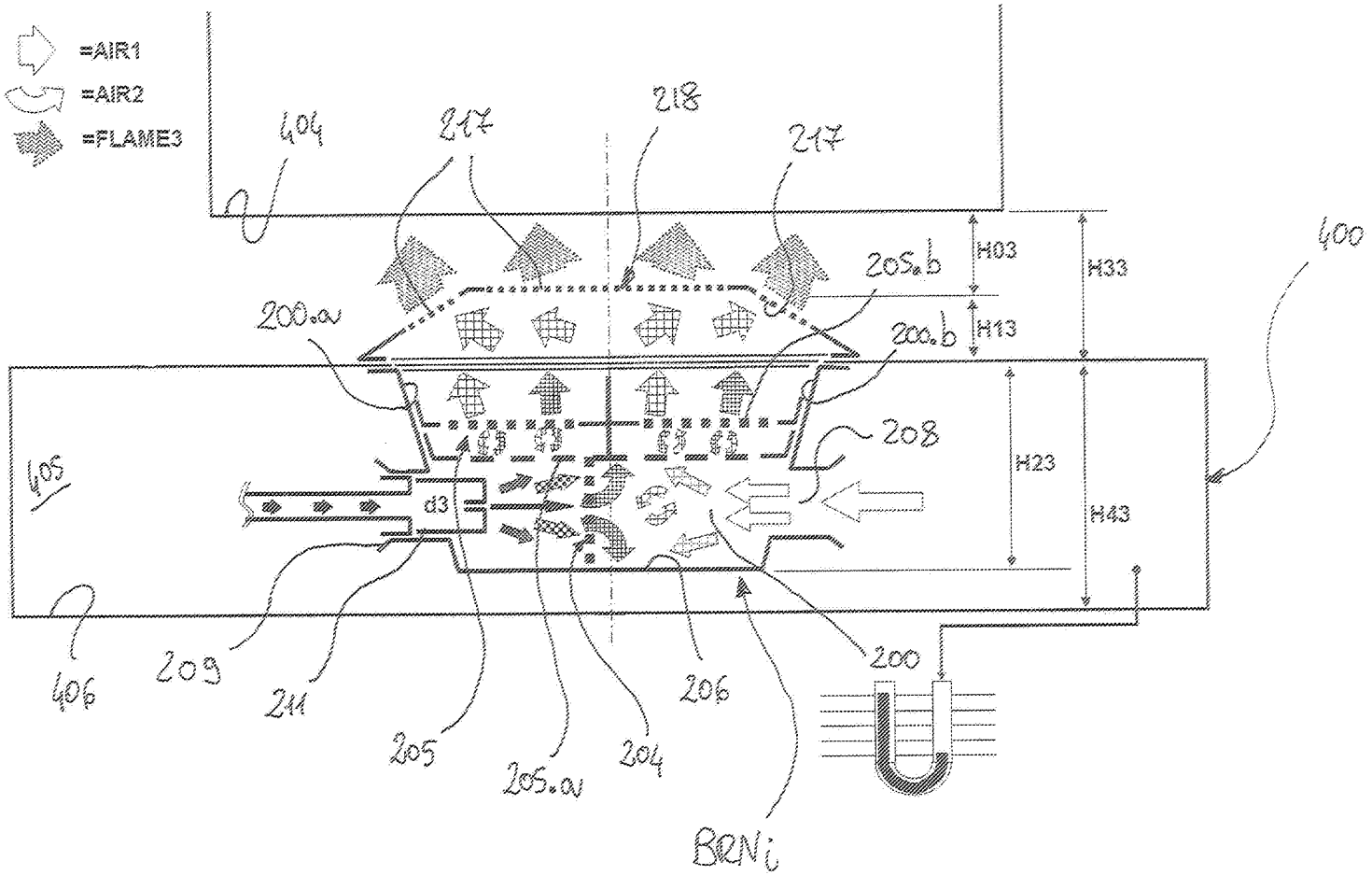
Figure 16:
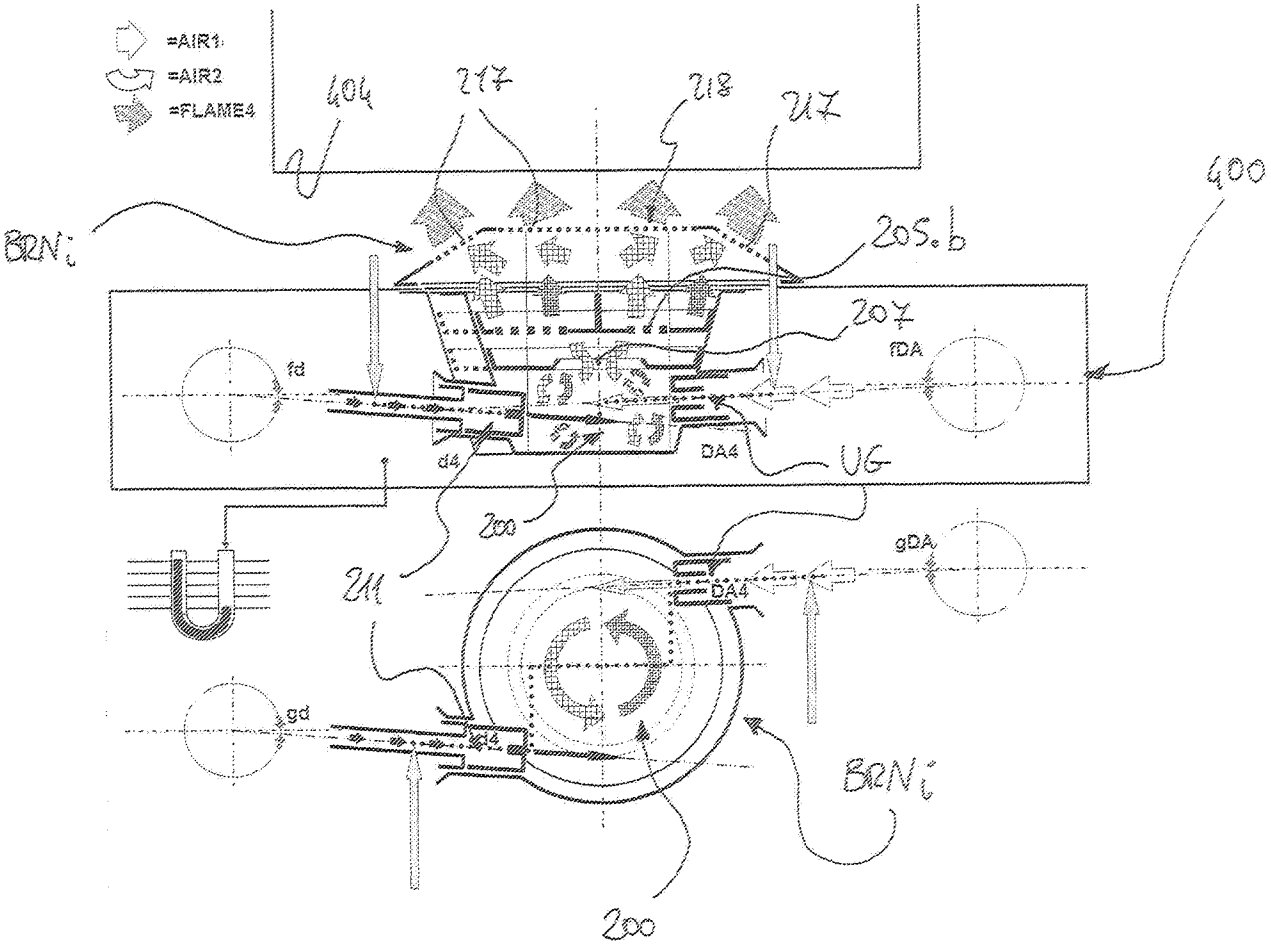

FIG. 5 schematically shows a premix boiler according to the prior art;

FIG. 6 schematically shows a possible embodiment of a dosing valve for a premix boiler according to the prior art;

FIG. 7 schematically shows, in vertical section, a ventilated hob according to the prior art;

FIG. 8 schematically shows, in vertical section, a ventilated hob according to a possible variant of the invention;

FIG. 9 schematically shows, in vertical section, a ventilated hob according to a further variant of the invention;

FIG. 10 schematically shows, in vertical section, a ventilated hob according to a further variant of the invention;

FIGS. 11*a* and 11*b* respectively show a section view of a component of the hob of FIG. 10 and, schematically, a detail thereof;

FIG. 12 schematically shows, in vertical section, a hob according to a further variant of the invention;

FIG. 13 shows a first graph illustrating the correlation among some characteristic parameters of the operation of the hob according to at least some of the multiple variants of the invention;

FIG. 14 schematically shows, in vertical section, a possible embodiment of a burner of the ventilated hob according to the invention;

FIGS. 15*a*, 15*b*, 15*c*, 15*d* and 15*e* schematically show, in vertical section, further embodiments of a burner of the ventilated hob according to the invention;

FIG. 16 shows an optimization for the embodiment of burner of FIGS. 15*a*-15*b;*

Figure 29:
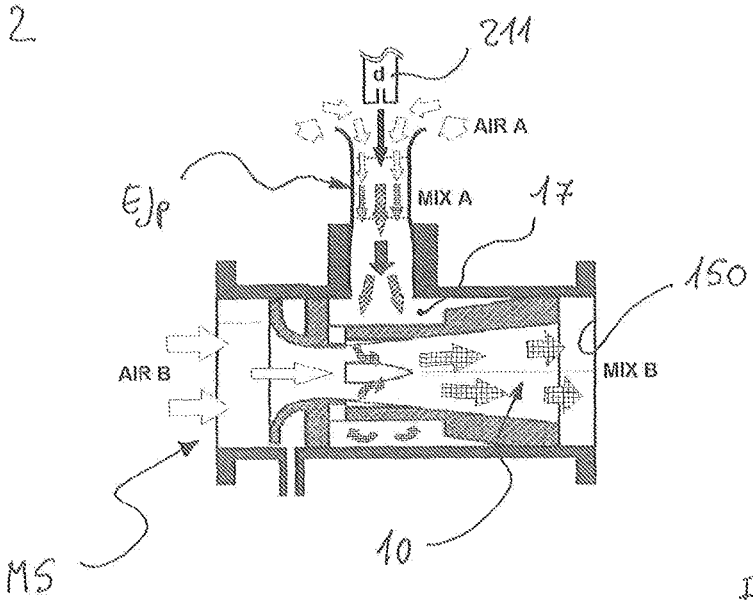
Figure 17:
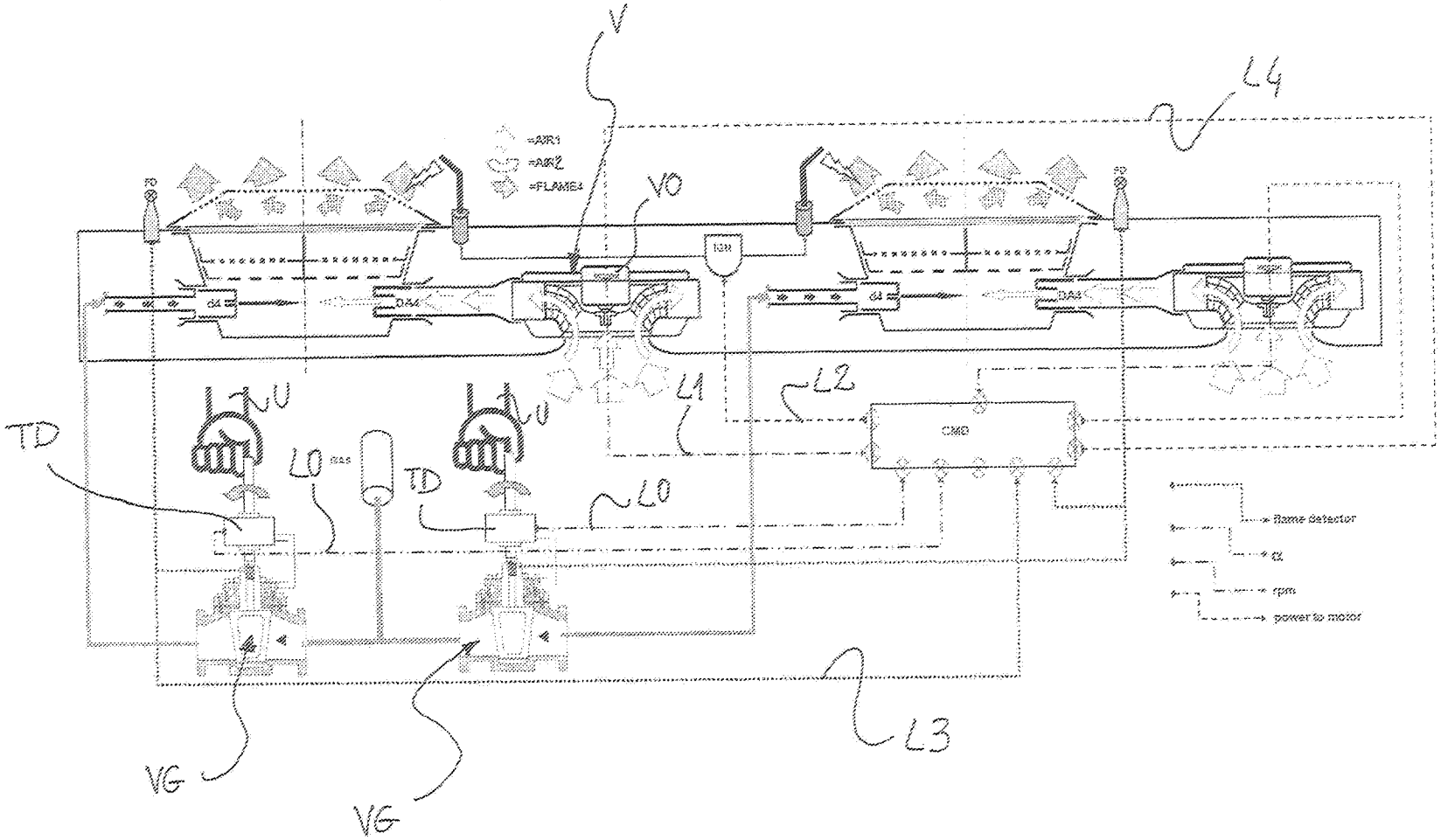
Figure 18:
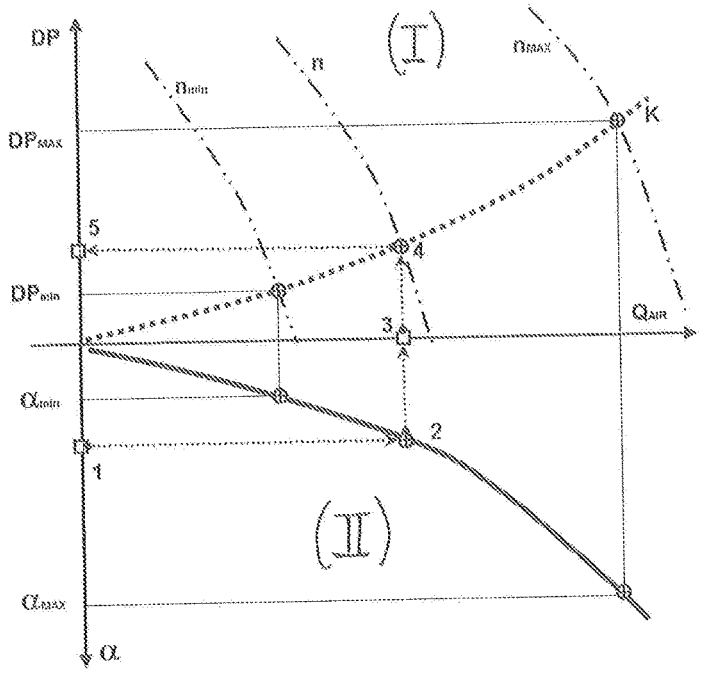
Figure 19:
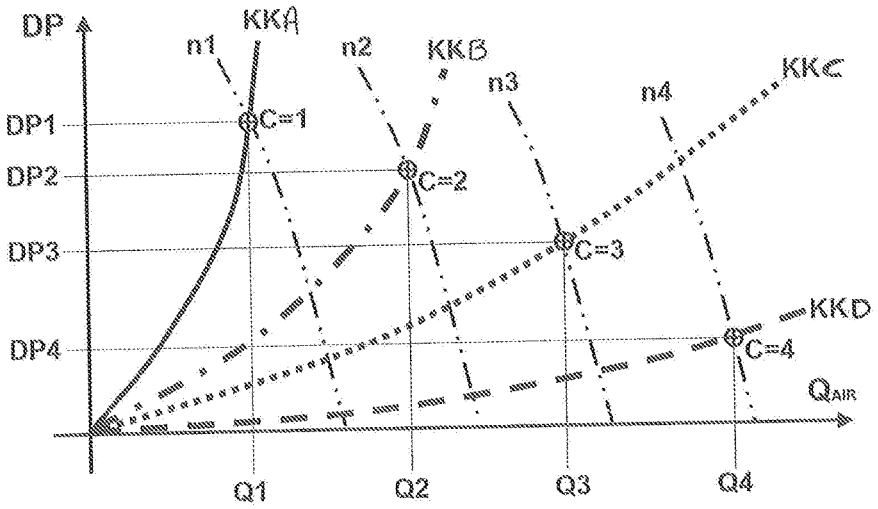
Figure 22:
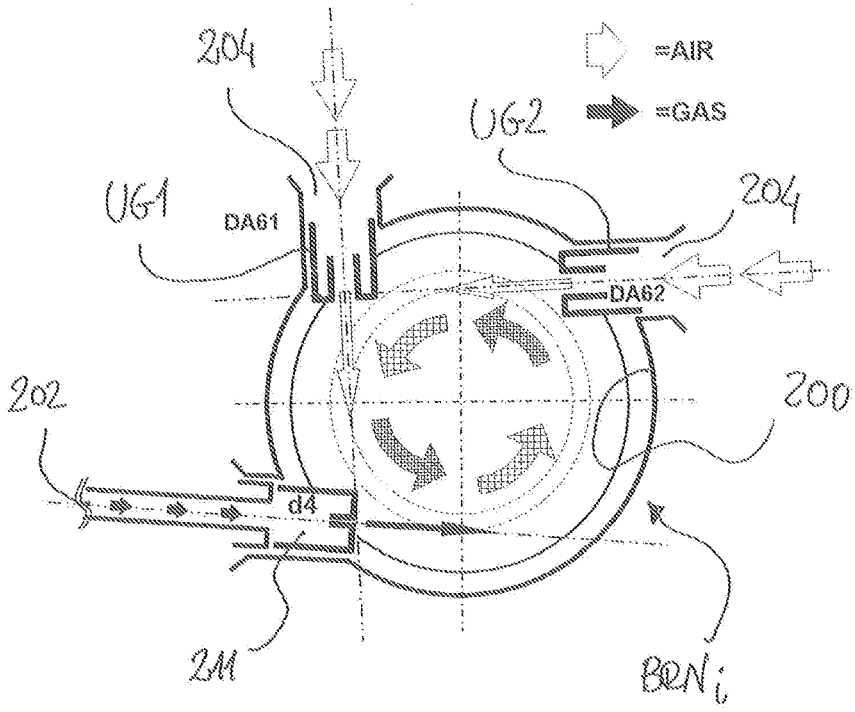
Figure 23:
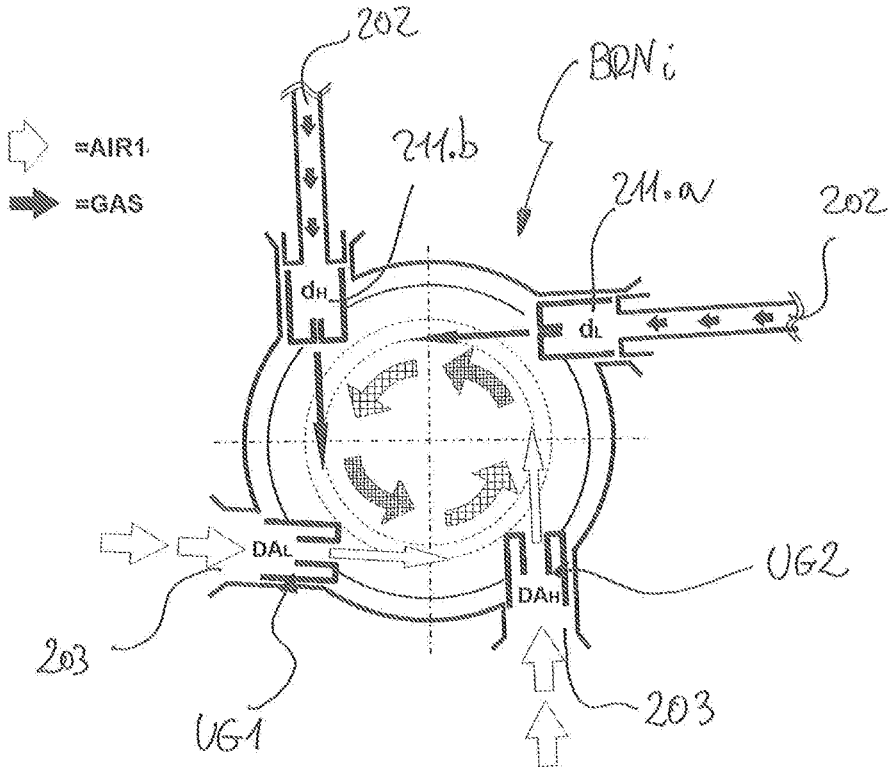
Figure 24:
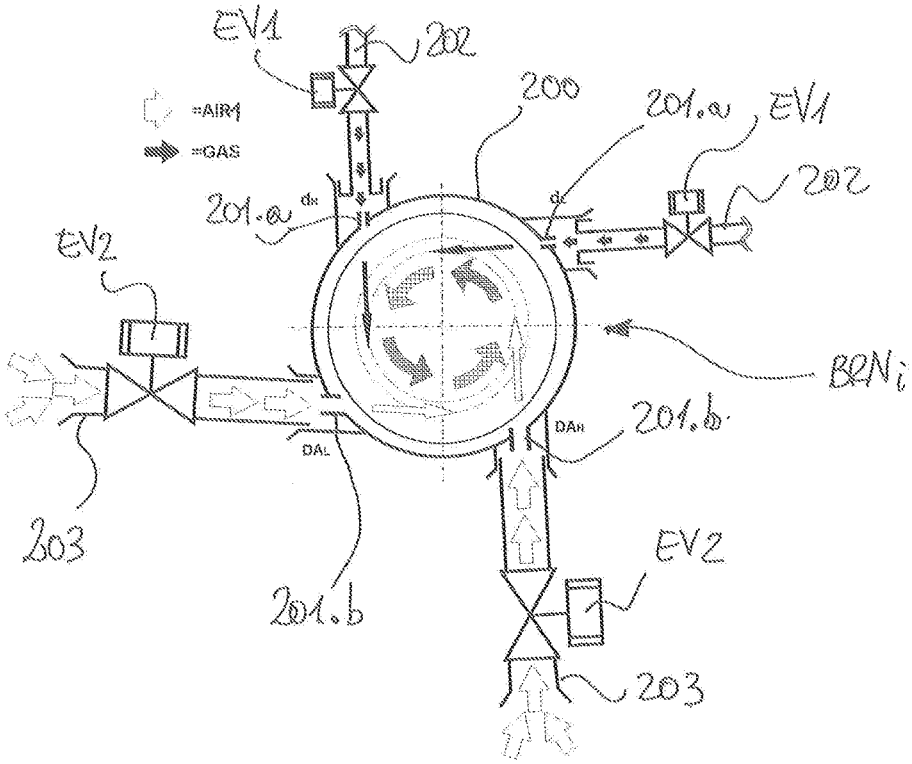
Figure 25:
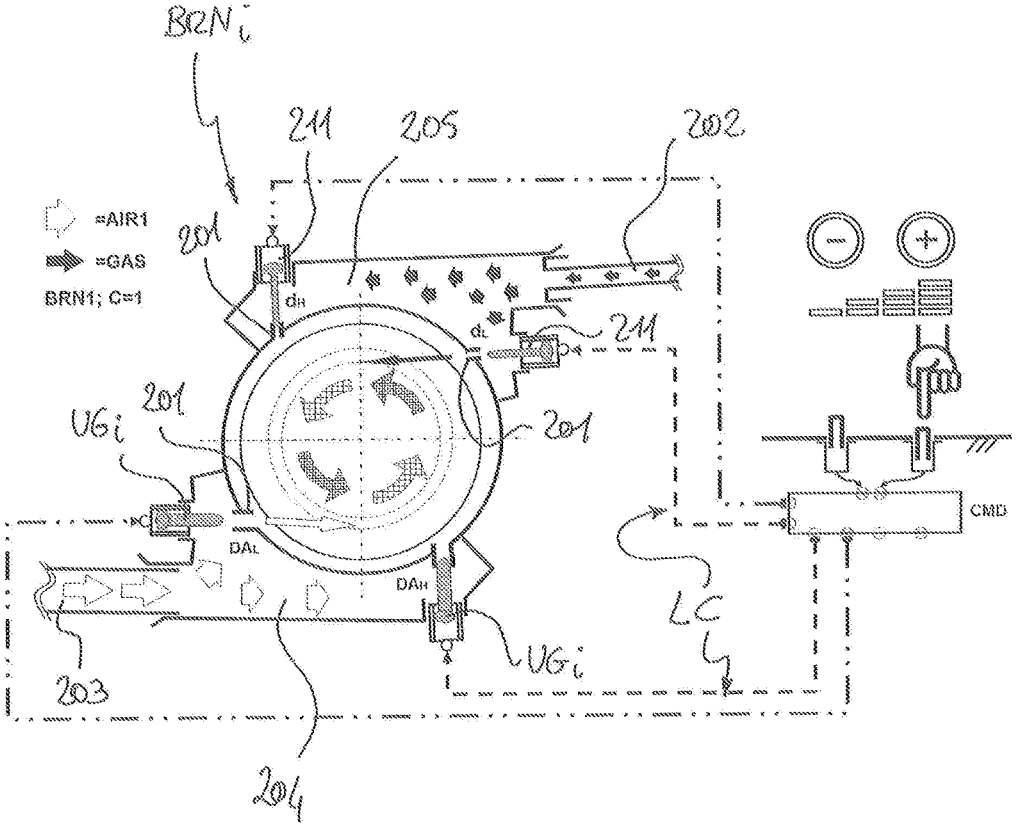
Figure 26:
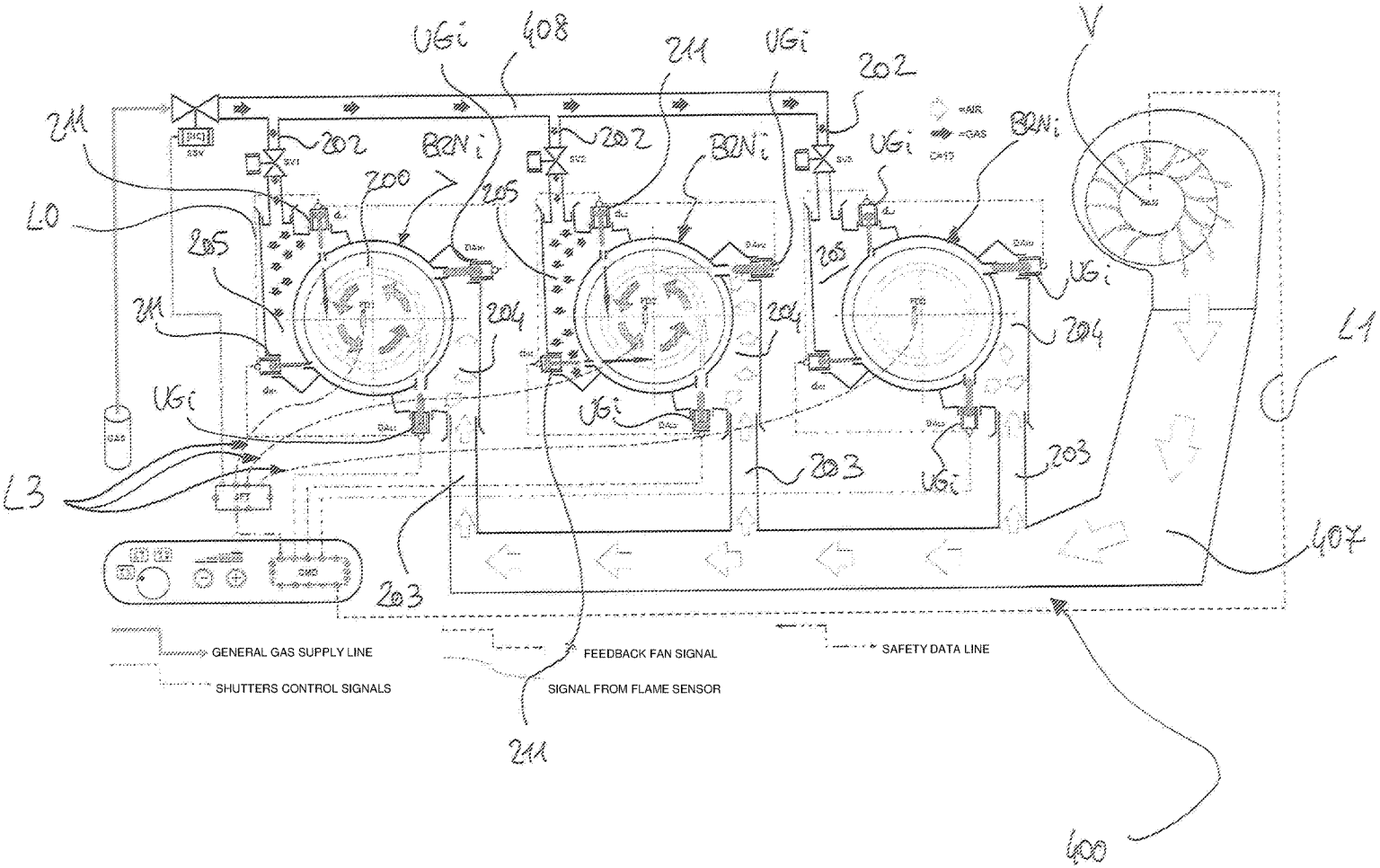
Figure 27:
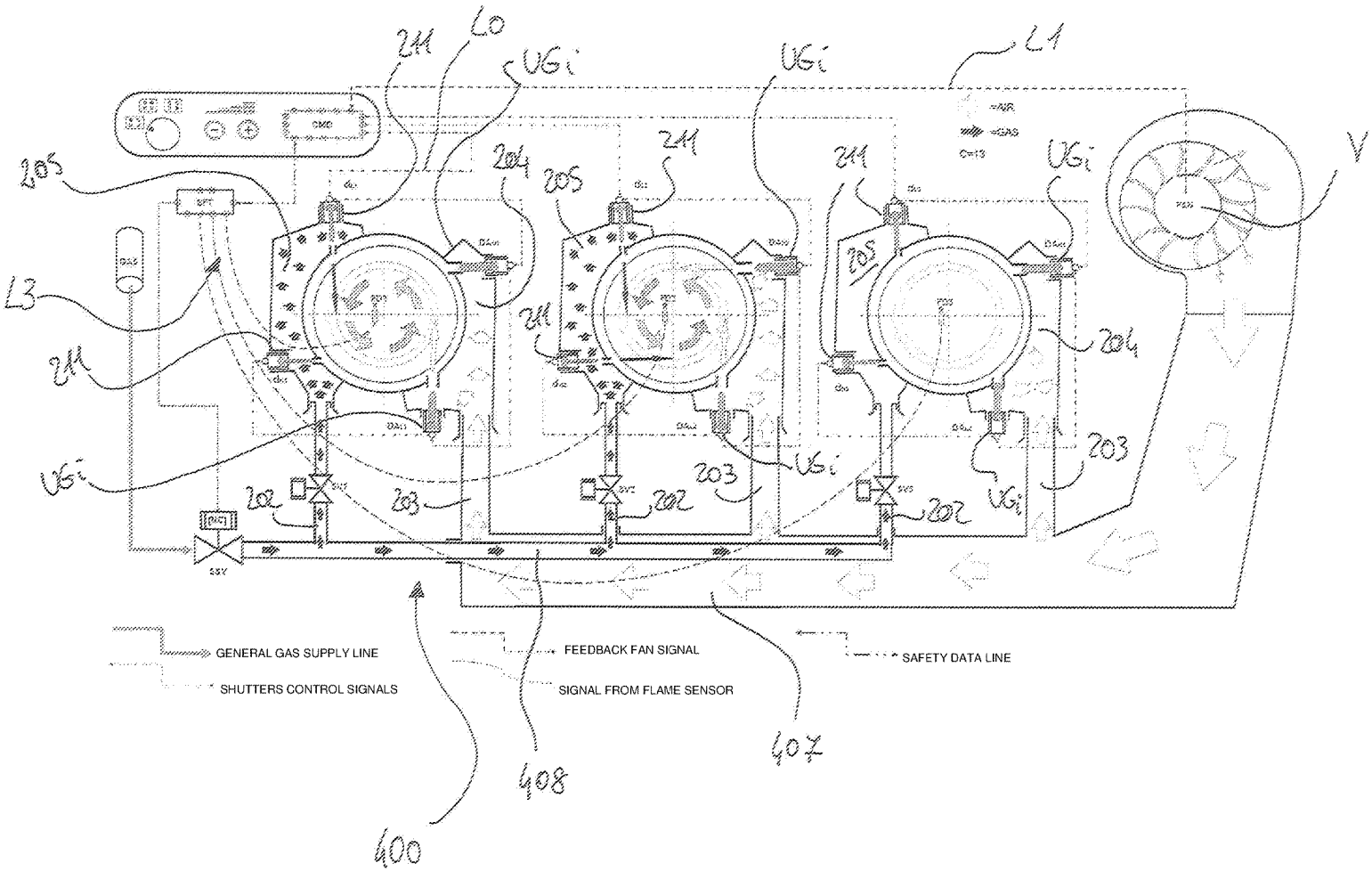
Figure 28:
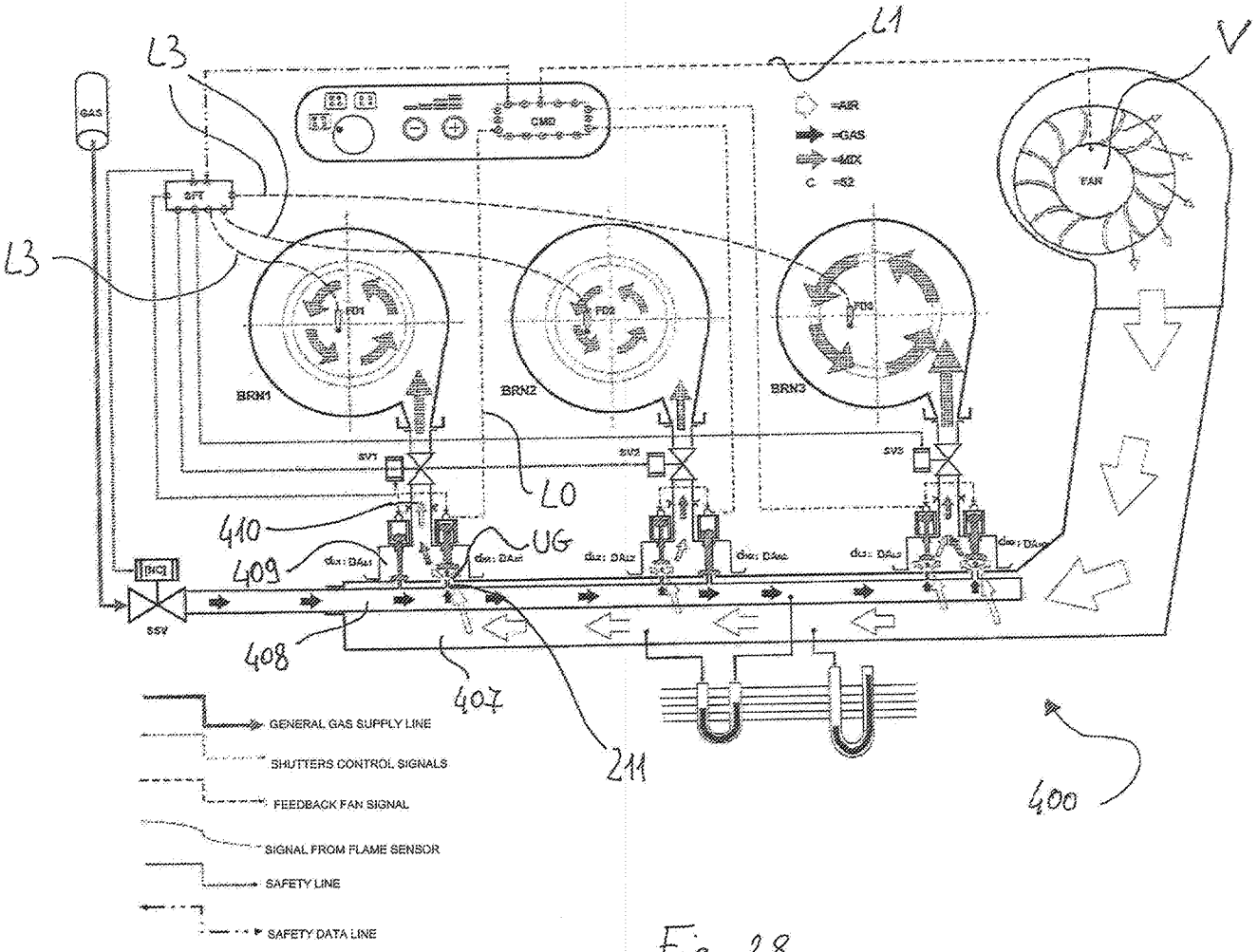

FIG. 17 schematically shows, in vertical section, the management and control system of a hob according to the invention;

FIG. 18 shows a second graph illustrating the correlation among some characteristic parameters of the operation of the hob according to at least some of the multiple variants of the invention;

FIG. 19 shows a third graph illustrating the correlation among some characteristic parameters of the operation of the hob according to at least some of the multiple variants of the invention;

FIG. 20 shows a fourth graph illustrating the correlation among some characteristic parameters of the operation of the hob according to at least some of the multiple variants of the invention;

FIGS. 21*a*, 21*b*, 21*c* show "configuration tables" (also called "mappings") of the hob of the invention corresponding to the graphs of FIG. 18, 19, 20, respectively;

FIG. 22 shows, in horizontal section, a further variant of burner for the ventilated hob of the invention;

FIG. 23 shows, in horizontal section, a further variant of burner for the ventilated hob of the invention;

FIG. 24 shows, in horizontal section, a further and alternative variant of burner for the ventilated hob of the invention;

FIG. 25 shows, in horizontal section, a further and alternative variant of burner for the ventilated hob of the invention;

FIG. 26 shows, in horizontal section, a possible executive and construction embodiment for the ventilated hob of the invention;

FIG. 27 shows, in horizontal section, an alternative embodiment for the ventilated hob of the invention;

FIG. 28 shows, in horizontal section, a further alternative embodiment for the ventilated hob of the invention;

FIG. 29 schematically shows an alternative variant to the burners according to the preceding figures.

Unless otherwise specified, any possible spatial reference in this report such as the terms vertical/horizontal or lower/upper refers to the position in which the elements are located in operating conditions while spatial terms such as previous/subsequent, upstream/downstream should be understood with reference to the direction of circulation of the flows of airforms.

Figure 1:
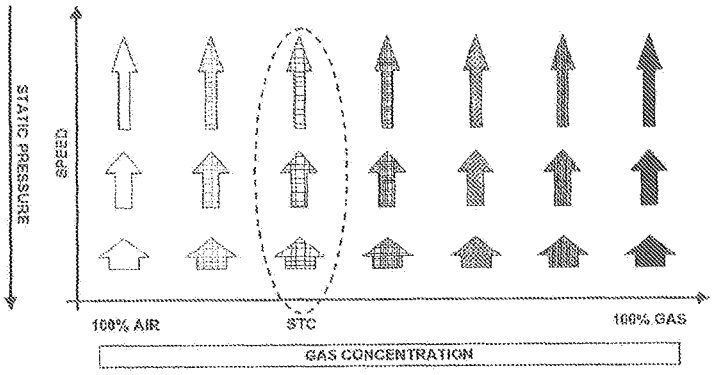
FIG. 1 shows, in a graphical legend, arrows symbolizing air-gas mixtures of different titre and inflow rate that are used by way of example, without any intent to provide quantitative data, in other figures.

In FIG. 1 arrows are drawn, each of which symbolizes a flow of mixture of a different speed and titre. These arrows are used in many of the subsequent figures to exemplify without any intent to provide quantitative indications, the substantial state of the air, gas and mixture thereof at various points upstream, downstream and inside the illustrated burners.

In the examples to follow reference shall always be made to LIN type or "geometrically" and constructively equivalent burners.

Figure 2:
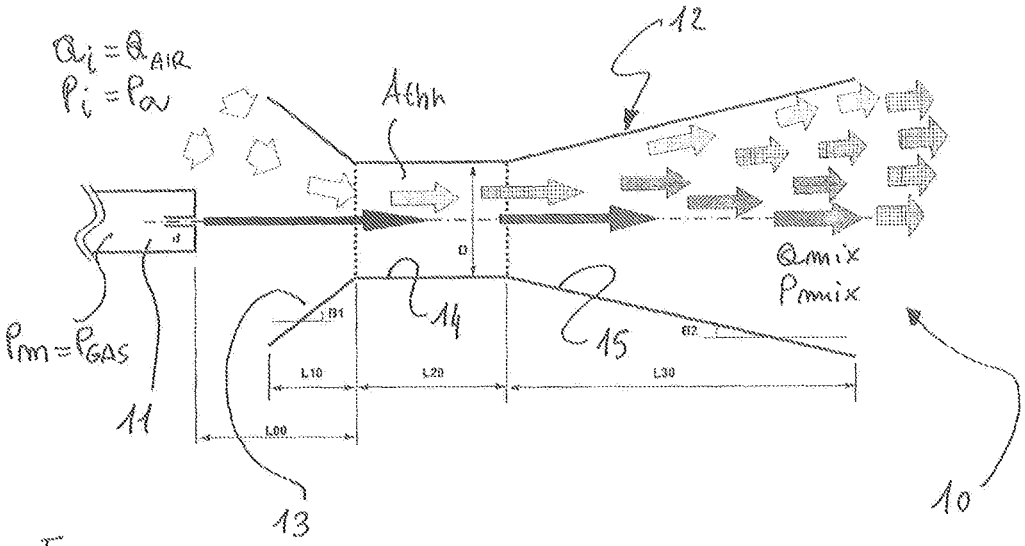
FIG. 2 shows, in a section view and schematically, a Venturi ejector.

Since it will be referred to several times in the following description, FIG. 2 schematically shows, out of scale, a Venturi ejector 10 with straight axis, which is the ideal shape to maximize its performance $\eta ej$.

The following are indicated of the ejector 10: the Venturi 12, the converging section (or, simply, the "convergent") 13; the groove 14 of diameter D; the diverging section 15 (also referred to as simply "divergent 15" or "diffuser 15"); the nozzle 11 located in the proximity of the inlet of the groove 14.

Figure 3:
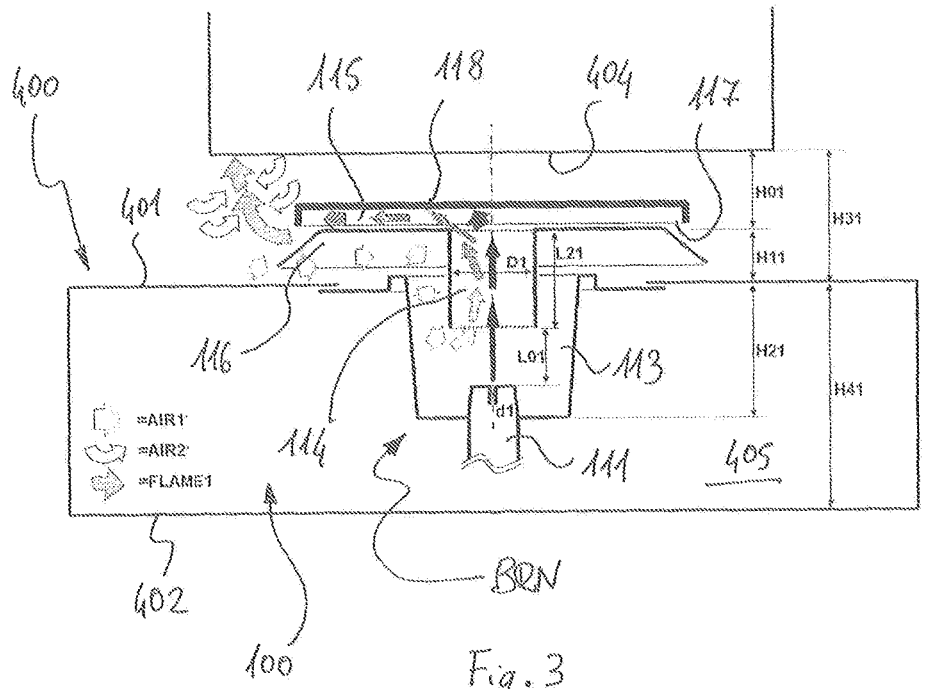
FIG. 3 shows, in vertical section, a burner of STD type.
Figure 4:
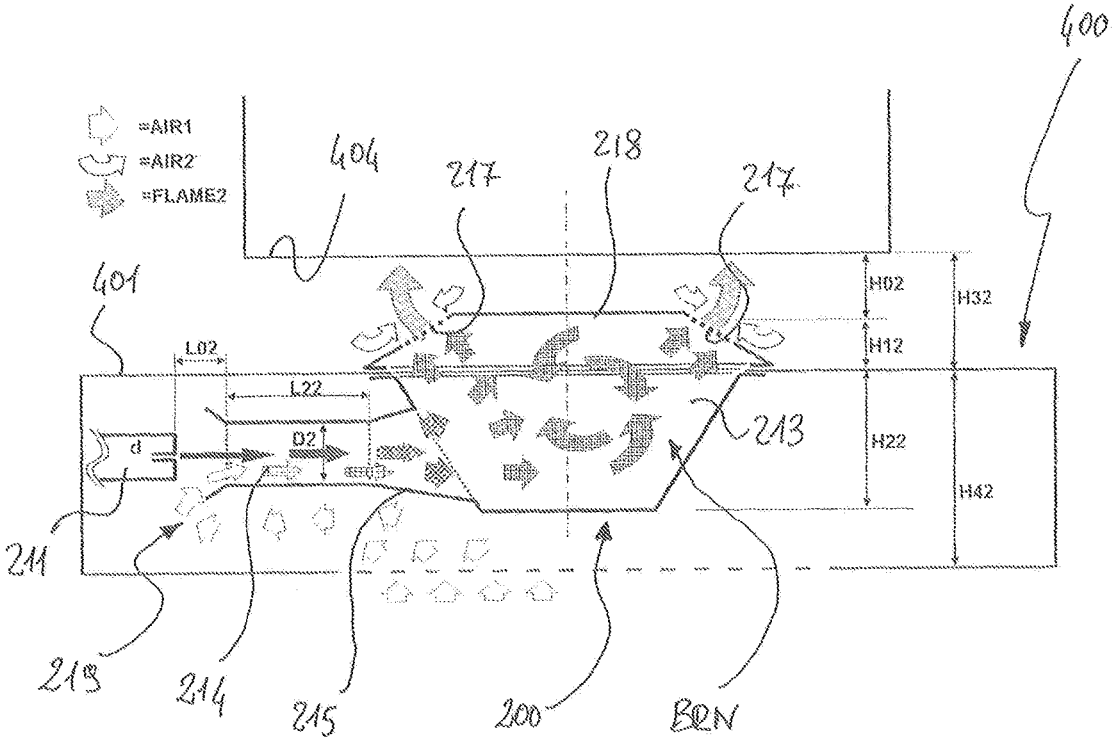
FIG. 4 shows, in vertical section, a burner of LIN type.

FIGS. 3 and 4 do not need particular and further comments showing a burner BRN of STD and LIN type, respectively, according to the prior art, and already widely described. Reference is herein made only to a few references that may be helpful for the full understanding of the invention, therefore: 400 indicates the hob as a whole; 401 its aesthetic covering top, which, however, for some variants of the present invention, also has functional purposes; 402 its bottom, that is to say the surface that confines it inferiorly; 404 the bottom of a pot resting on a grid above the burners BRN; a grid that, for greater clarity of the illustrations, is never drawn either in these figures or in the subsequent ones.

It is also reiterated that in both said known types of STD and LIN burners mixtures too rich in fuel are obtained that require the supply of additional air AIR2 (called, as known, "secondary") recalled by floating in the proximity of their slots 117, 217 and essential for the completion of the chemical reaction of combustion.

On the other hand, the technical, logistical and aesthetic advantages (which shall be referred to hereinafter) resulting from a flame already fully or substantially premixed with a stoichiometric titre STC (or over) in output from the slots 117, 217 of a burner of a household hob are known; for example, it is well known that this would lead to a minimization of the distance between the base of the flames and the bottom 404 of the overlying pot favouring as a consequence high $\eta_b$ values (ratio between the heat transferred to the pot and the heat produced by the burner) and to the minimization of the distance between the base of the flames and the aesthetic surface 401 of the hob 400 integrating one or more burners; the reduction of the minimum distance between pot and hob 400 eliminates the aesthetic impact, very often negative, of the grids and favours innovative and modern designs for said hobs.

A full air-fuel gas premixing, not achievable with the traditional STD or LIN burners, allows to achieve greater power densities by further limiting the radial extension of the "bed of flames"; these may also be distributed and oriented in any way as any input of external secondary air in the proximity of the slots 117, 217 of the cap 118, 218 of the burner BRN is no longer needed.

Without any limiting intent, this allows to significantly increase $\eta_b$ in the case of small pots (typical example: the coffee-makers often have a smaller bottom than the crowns of flames); to increase the contact time of the incandescent fumes with the bottom of the pot (the pot being the same); to minimize the dilution and cooling effect of the flame by the outside air since the perimeter of the bed of flames reduces (in fact, the floatation recalls a centripetal-vertical flow of secondary air that, however, rather than taking part in the combustion decreases the temperatures of the periphery of the bed of flames); to limit beforehand the risk of excessive production of [CO] (hence the ratio $[CO]/[CO_2]$ remains systematically below the minimum limits imposed by the regulation).

Among the solutions already available to try to obtain a systematically premixed combustion (hereinafter, for descriptive simplicity, "premixed" or also "premix") or with a controlled excess of secondary air, as already seen, those providing the use of active devices for moving air integrated to the same hob are known.

An example of the prior art, just mentioned before, that has not proved to be sufficiently practical and economically and constructively advantageous, is illustrated in an extremely schematic way, in FIG. 7 where each BRNi burner of the household hob 400 is associated to:

- a gas regulation valve VG (mechanical or electrical) for the supply of fuel gas to the burner BRNi and the relative supply conduit CG a supply conduit CA of the combustion air, capable of mixing inside the cup 200 of the same burner BRNi a motor-driven fan that, in the example in the figure, is positioned upstream of said conduits CA.

The thermal power of each burner BRNi (and therefore globally of the of hob 400) is always regulated by means of said fuel gas supply pressure regulating valves VG, more precisely, according a preferred embodiment, as a function of their "opening α degree" chosen and set by a user by acting, e.g., on a knob of the rotary type or on a push-button panel (not shown). Said "opening α degree" is then suitably detected and processed by known means (e.g., by an electric control circuit, not shown) to modulate the rotation speed of the single fan V associated and dedicated to the single burner BRNi. This operating situation is symbolically represented in FIG. 7 by the connection wiring (see "dotted arrow") between the gas valve VG and the fan V.

Another constructional solution, that allows keeping the stoichiometric ratio of the air-gas mixture substantially constant (even if not without difficulties), by "blowing" air to the burner BRNi in a constant ratio with the fuel gas flow delivered, functionally coincides with that used on the well known "premix boilers" (air flow as a function of the gas dosed). If compared to the traditional STD or LIN burners, of the passive type, the high structural, constructional and functional complexity of such hobs 400 that have in fact limited considerably its spreading on the market is immediately clear; for example, it is essential that the regulating valves are capable of transmitting a signal corresponding to their "opening α degree" to the corresponding fan V requiring, as a consequence, the presence of at least one control and processing unit.

Furthermore, installing, supplying and backoperating (e.g., by means of pressure sensors) a fan V for each burner 1 may be complex as well as economically disadvantageous from a constructional point of view.

The overabundant overall dimensions of such a hob may also compromise the overall aesthetics and/or the integration with other devices and the furniture of a kitchen. What seen thus far substantially relates to the prior art.

According to the invention, instead, (e.g., see FIGS. 8 and 9) a single fan V serves the plurality of burners BRNi of the hob 400, hereinafter also called "ventilated hob 400".

For simplicity of description the examples in question show a hob 400 comprising two burners BRNi, although nothing prevents the possibility of providing hobs implementing a greater number thereof.

More precisely, according to the variant of FIG. 8, the only fan V pressurises a sealed circuit CA1, inside compartment 405 of the hob 400, which supplies combustion air to all the burners 1 through suitable air lines CA10, CA11 . . . CAn.

According to an alternative simplified variant (see FIG. 9), said sealed circuit CA1 may directly consist of said compartment 405 of the hob 400, made sealed, eliminating, in fact, all the inner tubing defining the air lines CA10, CA11 . . . CAn, previously listed.

The term "pressurization" therefore means that the pressure of the combustion air provided by the fan V is greater that the ambient one (generally coinciding with the atmospheric one). In both variants, each burner 1 may carry a throttle valve VP that regulates the inflow of combustion air (preferably preceded by a correspondent shut-off valve, not shown in FIGS. 8 and 9).

Preferably, said throttle valves VP are installed directly on the cup 200 of the burner 1.

Nothing prevents, obviously, especially for the variant of FIG. 8, the possibility of their installation in any point between said fan V and the cups 200 of the burner 1, e.g. along the relevant air lines CA10, CA11.

It is therefore clear that, according to a totally general solution of the invention, which shall be referred to hereafter, the presence of said throttle valves (or, as will be seen, of equivalent "fine regulation" mechanical means) allows a "local" regulation of the air flow $Q_{AIR}$ to be supplied to the single burner BRNi at a substantially constant and fixed pressure of the compartment 405 (also called "plenum" 405) of the hob 400 or the relative supply sealed circuit CA1.

In other words, from here on, "local regulation" of the combustion air flow shall be understood as that substantially localised regulation in the proximity of each single burner BRNi keeping an internal pressure of the compartment 405 or the relative sealed circuit CA1 that remains substantially constant.

According to an alternative general solution of the invention, as will be seen later, said fan V may be able to regulate its rotation speed,) so as to ensure a combustion air pressure inside the compartment 405 of the hob 400 or the relative sealed circuit CA1 such as to meet the air flow $Q_{AIR}$ requested locally by each single burner BRNi.

This type of regulation of the air flow $Q_{AIR}$ shall be hereinafter referred to as "centralised". In fact, among the preferred solutions there can also be a combination of said "localised" and "centralised" regulations of the air flow $Q_{AIR}$ to be suitably supplied to the plurality of burners BRNi of the hob 400 of the invention.

Both with a "localised" and "centralised" regulation (or with a combination thereof), as will be seen, a stoichiometric or substantially stoichiometric air-gas mixture will be obtained without the need of input of secondary air from the outside.

These aspects, so far discussed in a very general manner, shall be referred to in the present description.

Below, reference will now be made to the "localised" solution (e.g. see the constructional solution of FIG. 9).

The combustion air passes through the throttle valves VP of each burner BRNi passing directly from the pressurised compartment 405 of the hob 400, which acts as a plenum, to the mixing zone with the fuel gas (supplied, as seen, by the relevant gas valves VG), inside the cup 200 of the same burner BRNi.

It is noted that, according to this variant, the throttle valves VP do not have to be subject to the stringent safety requirements of the corresponding gas valves VG; in fact, any poor sealing of the same does not involve any risk thanks to the presence of the pressurised compartment 405 (obviously with the fan V active).

Said air throttle valves VP univocally receive the positioning "signal" from the respective gas regulation valves VG (or from the control units of the same) without any need of a central control and regulation unit. In fact, as the type of fuel gas supplied to burners BRNi, the operating pressure of the air and of the same gas are known, and consequently:

the characteristic outflow curves of each throttle valve VP that define the air flow QAIR in input to the burner BRNi as a function of the angular position β of the control trim of said throttle valve VP (hereinafter called "air valve opening degree")

the characteristic outflow curves of each gas regulation valve VG that define the gas flow $Q_{GAS}$ in input to the burner BRNi as a function of the angular position α of the control trim of said gas valve VG (hereinafter called "gas valve opening degree")

the air/gas titre ($Q_{AIR}/Q_{GAS}$) to be ensured to each burner BRNi, parameters that are all supplied by the manufacturer of the hob 400, it is possible to correlate and definitively set a relation between the opening α degree of each gas valve VG and the opening value β of the air passage section of the corresponding throttle valve VP.

Such relation is graphically represented in FIG. 13 that shall now be briefly illustrated. Of that graph a first quadrant (i) is shown providing for the above opening α degree of the gas valve VG in the abscissa and the flow $Q_{GAS}$ in the ordinate; a second quadrant (ii) defined between the ordinate $Q_{GAS}$ and the abscissa with the air flows $Q_{AIR}$ (through the throttle valve VP) necessary to ensure a predetermined desired value of the titre of the mixture; a third quadrant (iii) in which the combustion air flow $Q_{AIR}$ is related to the opening β degree of the throttle valve VP; and a fourth quadrant (iv) in which the ordinate defined by said opening (β) degree of the air valve VP is opposed in the abscissa to the opening α degree of the gas valve VG.

In other words, on such first quadrant (s) there is defined a unique relation between the opening α degree of the gas valve VG and the gas flow $Q_{GAS}$ that it is able to deliver (shown in FIG. 13 by the outflow curve represented as a "dotted line"); in the second the correlation curve between the gas $Q_{GAS}$ and air $Q_{AIR}$ flows necessary to ensure a certain titre of the mixture; in the third there is represented in a dashed line one of the outflow curves of each air valve VP; in the fourth quadrant (iv) the correlation curve between said opening α, β degrees of the gas VG and air VP valves.

Therefore, once a certain opening α degree of the gas valve VG, indicated by point 1 in FIG. 13, has been set by the user of the hob 400 (by acting, as already said, on the control knob or push-button panel of the hob 400) the corresponding gas flow $Q_{GAS}$ that the gas regulation valve VG supplies to the burner BRNi (point 2) is instantly and univocally known; from it, it is therefore possible to go back to the corresponding air flow $Q_{AIR}$ necessary in order to keep constant the titre STC of the mixture within the burner BRNi (see point 3) and to the opening β degree of the throttle valve VP (indicated by point 4).

In general terms, α and β mean the geometric parameters associated, respectively, to the opening degree of the gas valve VG and to the opening degree of air valve VP.

Figure 11:
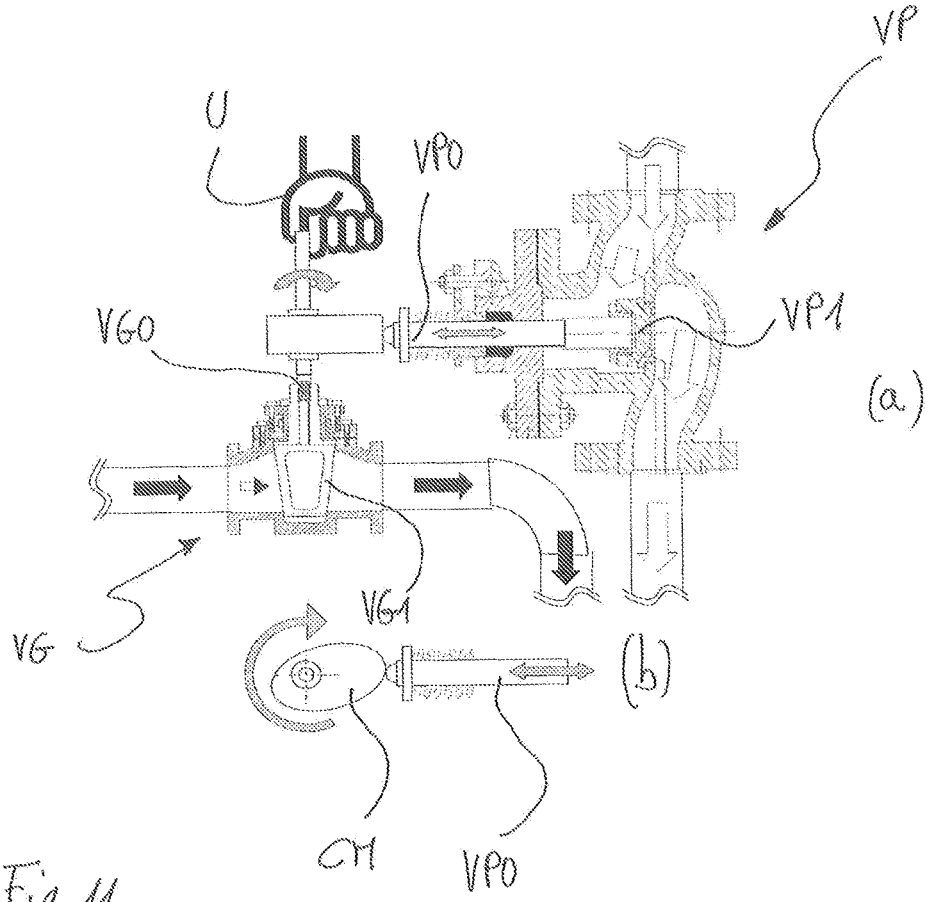

By way of a non-limiting example, more precisely, said geometric parameters α and β may consist of angular or linear parameters defining rotation or sliding of the shutters of the respective gas VG and air VP valves. In the example of FIG. 11, α is the angular geometric parameter that defines the rotation degree of the shutter VG1 of the gas valve VG from its "normally closed" position while β means that parameter which defines the opening degree of the shutter VP1 of the air valve VP starting from its "normally closed" position.

Several kinematic mechanisms are possible to mechanically establish the right correspondence between the opening α degree of the gas valve VG and the opening β degree of the relative air valve VP.

According to a possible embodiment of the invention, by way of a non-limiting example, such a correlation between the opening angle α of the gas valve VG and that β of the combustion air throttle valve VP (β=β(α)) can be technically achieved by incorporating the air throttle valve VP and the gas regulation valve VG in a single valve body (generally metallic) in which the trim VG0 of the gas valve VG actuates the trim VP0 of the air valve VP (that may be of the linear type, e.g., globe also called "streamlined flow") through a cam CM (see detail in FIG. 11*b*) connected to them.

As schematically shown in FIG. 11*a*, the trim VG0 of the gas valve VG has axis preferably perpendicular to that of the trim VP0 of the air valve VP, called VG0 and VP0, mechanically connected to each other, by regulating the position of the gas VG1 and air VP1 shutters, respectively, of the corresponding gas VG and air VP valves.

Nothing prevents, obviously, the possibility of managing said correlation between the opening degrees α and β of the gas VG and air VP valves electromagnetically or electronically; for example there may be provided more complex systems employing electrical signals of the position of the shutter VG1 of the gas valve VG thereby transmitted to an electronic positioner on board of the air throttle valve VP able to receive them and to consequently set the position of the relative shutter VP1.

Moreover, the air valve VP does not have to be necessarily of the type shown, by way of a non-limiting example only, in FIG. 11 (it could be, e.g., a known and simple "throttle valve").

Choking "mechanical" systems" of the combustion air supplied by a single fan V to the burners BRNi of the hob 400 of the invention, alternative to the above valves VP are shown in FIGS. 10 and 12.

It is useful to note that said alternative systems lend themselves to the possibility of retrofitting, or in any case changing/adapting, without heavy disruptions of the traditional product lines, ventilated hobs 400 that are traditional or already on the market/installed.

For example, FIG. 10 shows a traditional hob 400 comprising multiple burners BRNi (however, for simplicity of description, only one burner BRNi, preferably of the linear LIN type, is drawn) and an inner compartment 405 pressurised by a fan V (and wherein the overpressure is kept substantially constant).

Once said burners BRNi are set to ensure stoichiometric mixtures (STC=100%), by decreasing, for example, the thermal power required to the burner BRNi (and thus the gas flow $Q_{GAS}$) increasingly "leaner" mixtures will be systematically obtained, as already widely seen, that is with an increasingly abundant excess of combustion air.

As a consequence, in order to maintain a stoichiometric titre STC on all thermal power regulation range of the burner BRNi it is necessary to provide said combustion air choking system capable of varying the flow in input to the Venturi ejector 10 as a function of the opening $\alpha_i$ degree of the gas valve VG, (the latter set by the user U by acting on the control knob/push-button panel).

Such active system for the "fine regulation" of the power of a burner BRNi may provide a mobile device at the converging portion 13 of the ejector 10, adapted to reduce and "choke" the useful air passage section.

More in detail, such mobile device 101 may consist of a mobile shutter 101 the position whereof may be mechanically correlated, as anticipated, to the opening $\alpha_i$ degree of the shutter VG1 of the gas valve VG (that is to the gas flow $Q_{GAS}$ in input to the burner BRNi). Said mobile device 101, according to this variant, is then mechanically connected, through known kinematic mechanisms, to the control trim VG0 of the shutter VG1 of said gas valve VG.

As an alternative, by way of a non-limiting example, such mobile device 101 may consist of:

means adapted to reduce the distance L02 (see FIG. 10) between the injector 211 downstream of the gas valve VG and the groove of the Venturi ejector 10, for example by making telescopic the converging portion 13-groove 14 of the ejector 10 so that it can shift progressively towards said fixed injector 211;

means adapted to reduce the section D02 of the groove 14 of the Venturi ejector 10, for example by means of an iris (not shown) interposed between the converging portion 13 and the groove 14 of said ejector 10 and/or by clapet.

It is also possible to provide a variant according to which said mobile device is the same gas injector 211 capable of shifting towards the convergent 13 of the Venturi injector 10 reducing in fact the useful section for the passage of air, supplied by the fan V, towards the cup 200 of the burner BRNi.

In addition to mechanical solutions that link the angular position $\alpha i$ of the trim of the gas valve VG to the linear shifting of the air-shutter 101 illustrated above, it is possible to provide for a variant of the pneumatic type: according to this variant the shifting of the air-shutter 101 may also be obtained preferably through pneumatic servo-controls 100.

For example, as shown in FIG. 12, the shifting of said air-shutter 101 may be obtained by connecting the same to a thrust mobile element 103 of a "bellows capsule 102" anchored, on the opposed surface 104, to a fixed element, for example the frame of the hob 400. The capsule 102 is free to deform elastically in the longitudinal direction (normal to the fixed and mobile surfaces) according to the pressure difference between its inner compartment 105 and the outside environment; moreover, a traction spring 106 is seated therein that would tend to cause the same capsule 102 "to implode".

The inner compartment 105 of the capsule 102 is pneumatically connected through a small tube 107 to the portion 202.*a* of a conduit for connecting the gas valve VG to the relative injector 211. In this way it is the actual supply pressure of the injector 211 to univocally determine the position of the air-shutter 101 through the management of the preload of the spring 106.

At this point the other mode, called "centralised", for regulating the air flow suppliable in suitable and specific amounts to the various burners BRNi of a hob 400 shall be analysed that, as anticipated, may be alternative or combined to that "localised" just described above in its multiple embodiments.

In this regard, it is worth to preliminarly specify the advantages that may derive from the pressurisation of the compartment (or plenum) 405 of the hob 400.

It is known that working at too low pressures (for example, by providing the use of an axial fan V) the throttle valves VP should have a high nominal diameter to avoid creating too high load losses; this entails obvious problems of overall dimensions and weights; on the contrary, high pressures (e.g., by providing a centrifugal/blower fan V), close to the gas supply pressures, (e.g., from 20 to 30 mbar) would enable the installation of much more compact air throttle valves but, above all, the possibility of replacing them with air injectors totally similar, architecturally and functionally, to the gas ones (provided that, preferably, means, e.g. tie rods, adapted to prevent phenomena of temporary deformations and/or convexities of the structure of the hob 400 due to above pressures involved are provided).

A first innovative solution with input of forced air is shown in FIG. 14 wherein a functional scheme of a burner BRNi (also called "premix burner") suitably optimised to work with an active supply of combustion air and for the generation of fully or substantially premixed flames is illustrated.

For simplicity, this figure shows only one of the burners BRNi of the hob 400 while the graphical illustration of the fan V that pressurises the compartment 405 is intentionally neglected.

According to this variant, what was the "cup 200" in the traditional burners it can now become an actual mixing chamber 200; the nozzle 211 of the fuel gas injector is, in fact, constrained to an input seat 209 (e.g., without loss of generality, by screwing) in a first zone 200.*a* of the side of said cup 200 so as to allow the replacement by a user U as the type of fuel gas supplying it varies.

The inlet 208 for the air pressurised by a fan V, is provided facing the gas injector 211 on an opposite second zone 200.*b* of the side of said cup 200, the said gas nozzle 211 and said air inlet 208 lying, opposed, substantially on the same horizontal plane. Due to this arrangement, between gas nozzle 211 and inlet 208 for the combustion air a permeable screen 204 (or equivalent means) is interposed inside the cup 200, that has the task of slowing down and dissipating the fuel gas jet, significantly faster than the air flow; in this way, the risks of gas interference or leak towards the pressurised compartment 405 of the hob 400 is avoided. Inside said cup 200, therefore, a first air-gas thrust mixing takes place (from here the fact that the cup 200 may be considered as an actual mixing chamber) that then continues vertically upwards up to the proximity of the slots 217 of the cap 218 of the burner BRNi 1. Preferably, according to the invention, between the first mixing zone inside the cup 200 and the relative cap 218 one or more grids 205, optionally removable by the user U, may be provided.

More precisely, FIG. 14 shows a premix burner within which two perforated grids 205.*a* and 205.*b* may be provided, the one overlapped to the other, that have the task of improving and homogenising the air-gas mixing and stabilise the flow until achieving a stoichiometric mixture STC (or rich in air) that proceeds towards the array of slots 217 of the flame spreading cap 218.

Without any limiting intent, preferably, the perforated grids 205.*a*, 205.*b* may differ from each other by number of holes and by shape and sizes of the same.

These grids 205, 205.*a*, 205.*b* may be called, for the function that they carry out, "homogenizer baffles" and define a plurality of mixing stages inside the cup 200 of the burner BRNi; for the burner of FIG. 14, for example, there are identified a first mixing stage comprised between the bottom 206 of the cup 200 and the first perforated grid 205.*a*; a second stage identified between the two grids 205.*a* and 205.*b*; a last mixing stage that develops between the upper perforated grid 205.*b* and the flame spreading cap 218. With this solution, compared to the traditional burners, it is possible to obtain premix burner BRNi with smaller vertical spaces of the cups 200 and a consequent reduction of the minimum height of the pressurised inner compartment 405 of the hob 400.

Nothing prevents, for example, that the bottom of such cup 200 may also be in direct contact with the bottom 406 of compartment 405 also because of the absence of the fuel gas supply tubes and their technical overall dimensions, despite what instead shown in the schematic drawings of the hob of at least FIGS. 7 to 9.

According to a preferred variant of the invention, the above seat 208 for pressurised air inside the cup 200 of a burner BRNi of the hob 400 may act as a seat for the calibrated air nozzles UG, as illustrated schematically in FIGS. 15*a* and 15*b*).

Please note that in this embodiment, which shall now be examined in detail, said air nozzles UG with calibrated and fixed opening may replace the air throttle valves VP with variable opening (or the equivalent mechanical regulation systems of FIGS. 10 and 12).

Air (ON/OFF) shut-off valves (not always in the annexed Figs.) shall instead continue to be present (even if not always shown) located upstream of said air nozzles UG (like what provided with the throttle valves VP).

According to such further variant of the invention, said air nozzles UG

- receive pressurised air from compartment 405 pressurised by the motor-driven fan V
- constrained (e.g. by screwing), as already anticipated, to the inlet 208 of a side wall 200.*b* of said cup 200 of the burner BRNi, extend within it (which, as seen, acts as a mixing chamber).

The fuel gas and the combustion air may be supplied to the burner BRNi by the respective injectors substantially at the same pressure, mixing inside the cup 200.

While also in such variant of burner BRNi the two gas 211 and air UG nozzles face each other, the presence of that permeable screen 204 previously described for the variant of FIG. 14 is no more required as the two flows of fuel gas and combustion air have, as said, the same pressure, sufficiently high, that prevents the leakage of said gas towards the pressurised compartment 405.

Also the burner BRNi of FIG. 15*a*-15*b* may instead comprise one or more perforated grids 205.*a*, 205.*b* inside the mixing chamber 200 adapted to promote and homogenise the air-gas mixing, obtaining substantially stoichiometric STC mixtures.

In order to maximise such beneficial effects, it is possible, as well as preferable, to constrain the gas nozzle 211 and the air nozzle UG on the respective opposed sides 200.*a*, 200.*b* of the cup 200 of the burner BRNi so that they are misaligned relative to each other. Such further construction variant of the burner BRNi of the invention, is shown in FIG. 16. Since the misalignment of the gas 211 and air UG nozzle generates a permanent vortex inside the mixing chamber 200 of the burner BRNi that improves the air-gas mixing, it is possible to provide, according to this variant, a first homogenizer baffle 205.*a* (or grid) that carries a single central opening 207 through which the air-gas mixture is forced in order to improve the homogeneity thereof (see FIG. 16).

The second homogenizer baffle 205.*b* may, instead, be totally similar to that already described with reference to the other variants of the invention.

Figure 15:
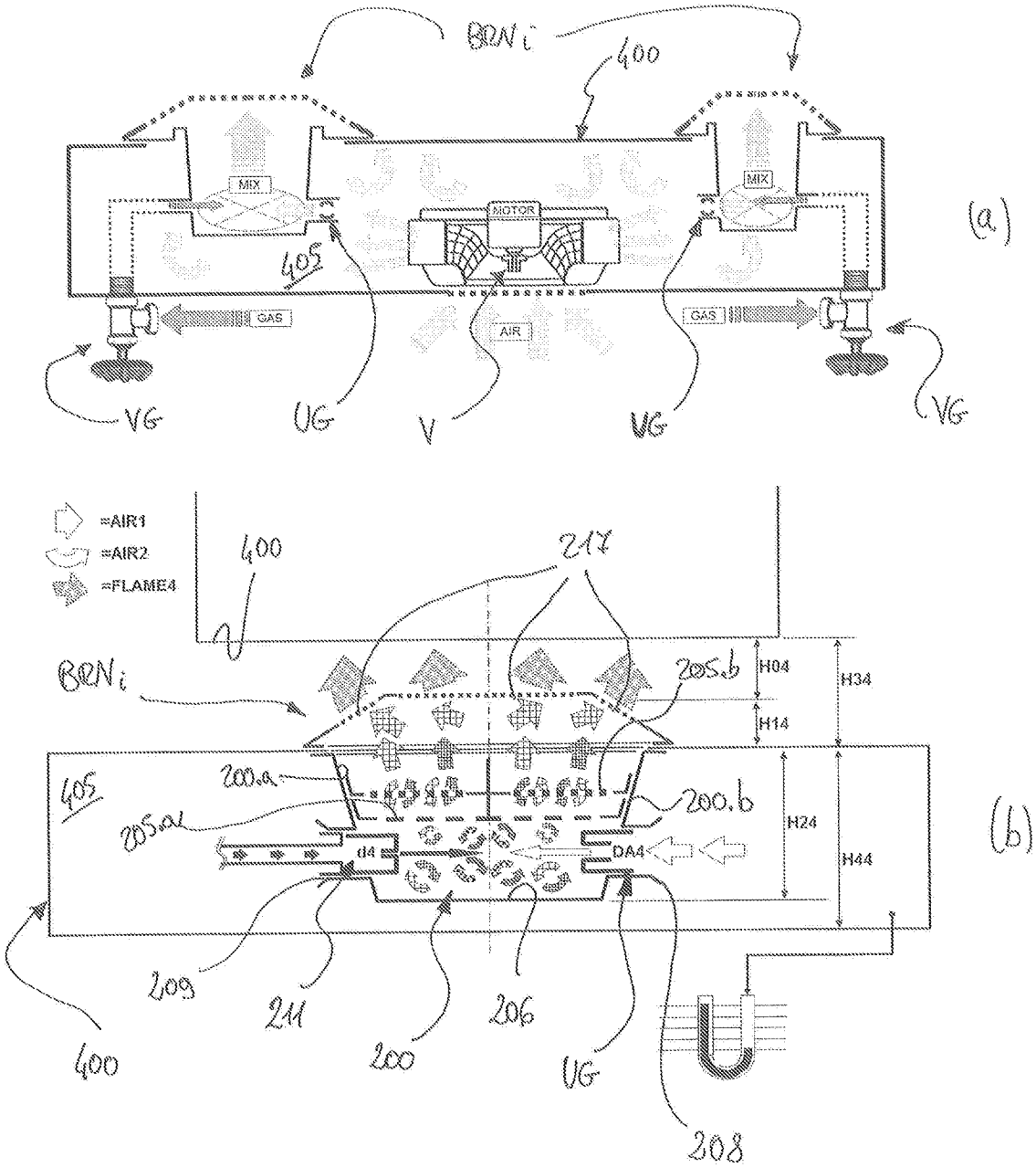
Figure 15C:
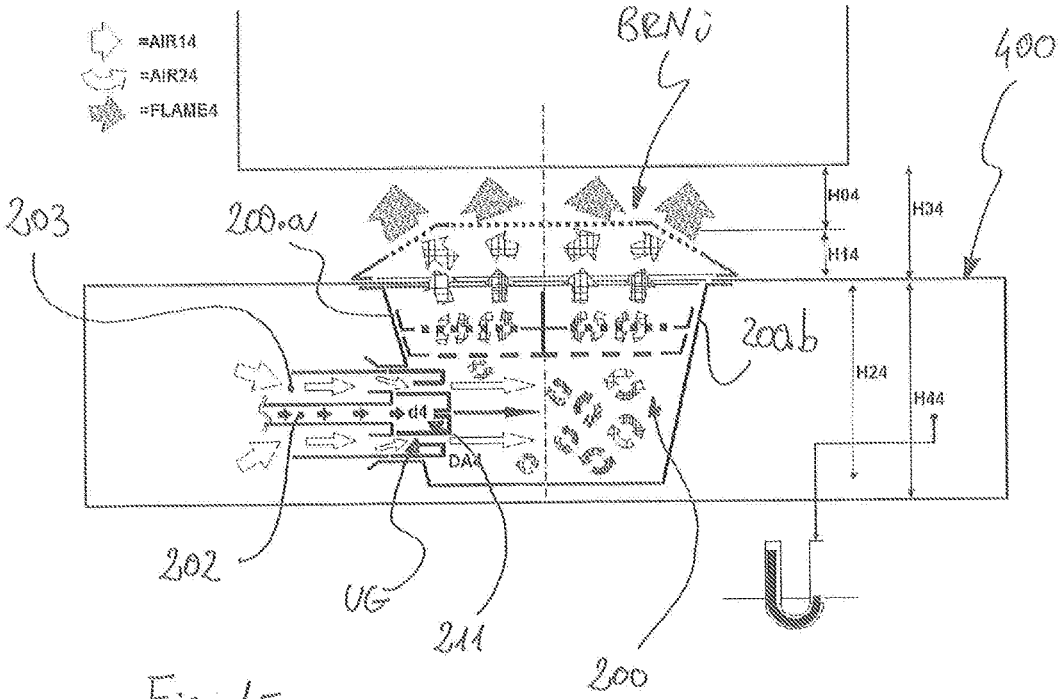
Figure 15D:
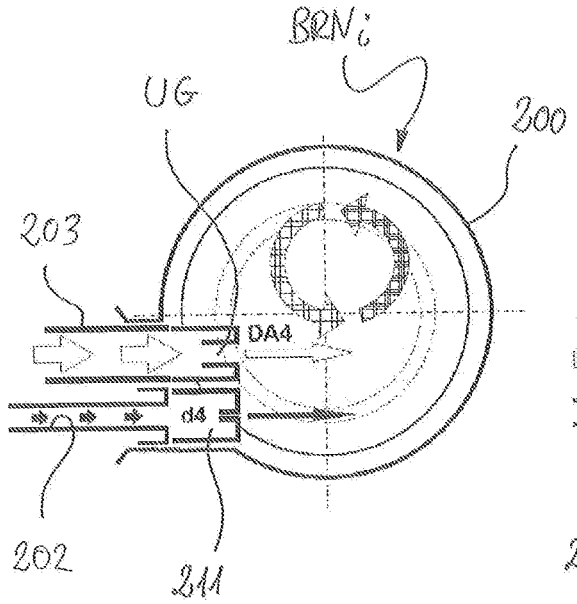
Figure 15E:
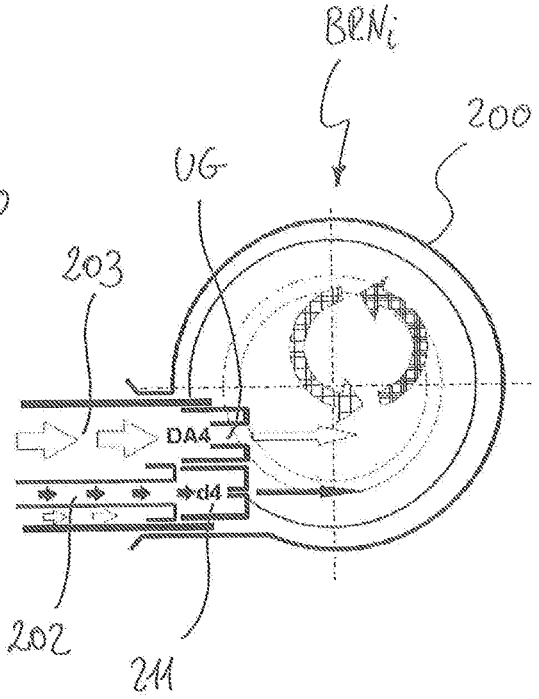

Further construction variants are shown in FIGS. 15*c*, 15*d* and 15*e*, according to which the air nozzle UG and the gas nozzle 211 are both constrained to the same inlet 2008 of a side 200.*a*; 200.*b* of the cup 200 of the burner BRNi.

More precisely, said nozzles UG, 211, which may also constitute a single component (replaceable as a function of the gas to be supplied), may be arranged concentrically (see FIG. 15*c*) or next (see FIGS. 15*d* and 15*e*) to each other.

In the variant with "concentric injectors" of FIG. 15*c*, for example, the air nozzle UG is arranged externally to the gas injector 211 and may be supplied by respective air 203 and gas 202 supply conduits, also concentric according to a known constructional solution, named "tube-in-tube".

In the variant with "side-by-side injectors", the air UG and gas 211 nozzles may instead be supplied both by the tube-in-tube solution already mentioned (FIG. 15*e*) and by supply conduits 202, 203 parallel to each other (FIG. 15*d*).

Even in all these configurations of the FIGS. 15*a*, 15*b*, 15*c*, 15*d*, 15*e* and 16, each calibrated nozzle UG for the air is preferably preceded by a "normally closed" shut-off valve (not shown) that is opened only when the burner BRNi is on.

Moreover, the sections of the air UG and gas 211 nozzles are generally much smaller than the section inside the cup 200 of each burner BRNi that acts, as said, as a mixing chamber (also called "plenum").

In the case in which each of such burners BRNi (i.e. integrating air and gas nozzles) of a hob 400, is served by a corresponding and dedicated fan V, a power regulation system may be provided according to the graph of FIG. 18 which provides an upper quadrant (I) having in the abscissa the air flows $Q_{AIR}$ suppliable through the air nozzle UG and in the ordinate the pressure drops DP astride said air nozzle UG (hereinafter called, for simplicity, "operating pressure DP" inside the pressurised compartment 405) and a lower quadrant (II) also having in the abscissa said air flows $Q_{AIR}$ but in the ordinate the opening $\alpha$ degree of the gas valve VG (of which, as seen, only the gas nozzle 211 is shown in the annexed figures).

More precisely, the upper quadrant (I) shows at least one of the possible characteristic curves $K_i$ of the air injector UG of the burner BRNi chosen by the manufacturer that defines the relation between the operating pressure DP and the air flow $Q_{AIR}$ flowing therein, while quadrant (II) shows the intrinsic characteristic curve of the gas valve VG, per se known once the air/gas titre ($Q_{AIR}/Q_{GAS}$) to be ensured to the burner is chosen.

Through such graph, therefore, the correlation between the air flow $Q_{AIR}$ flowing through the air injector/nozzle UG and the fuel gas flow $Q_{GAS}$ is defined, the latter being a function of the angular position $\alpha$ taken by the trim of the tap of the gas valve VG.

The graph of FIG. 18 also shows the characteristic curves of the fan V of the hob 400 (called "performance"), each corresponding to a constant number of revolutions "n".

It should be noted that the thermal power regulation range of the burner BRNi goes from a minimum, which corresponds to an opening degree $\alpha_{min}$ of the gas valve VG and an operating pressure $DP_{min}$ of the pressurised compartment 405 of the hob 400, ensured by a rotation speed $n_{min}$ of the fan V, to a "nominal" value obtainable at the maximum values $\alpha_{max}$, $DP_{max}$, $n_{max}$ of the opening degree of the gas valve VG, of the operating pressure and fan V speed.

Already from this graph, it is possible to realize how relatively simple is to ensure a substantially stoichiometric STC air-gas mixture and fully premixed flames as the thermal power required to burner BRNi varies as long as each of them, as said, is served by a corresponding and dedicated fan V.

This "simplified" case is illustrated in detail and "constructively" in FIG. 17, in which, among other things, the burner BRNi of the type described with reference to FIG. 15*b* are shown. Nothing prevents, obviously, the possibility of using the burners BRNi modified according to the variant of FIG. 15*c*, 15*d*, 15*e* or 16, also already described.

In this case, in fact, each fan V regulates its rotation speed according to the characteristic curves described above. More precisely, the rotation speed "n" of the fan V is regulated according to the value of the operating pressure DP to be reached in the pressurised compartment 405 of the hob 400 that, in turn, is a consequence of the thermal power required to the burner BRNi, i.e. of the opening $\alpha$ degree of the gas valve VG defined by the user U.

By way of a non-limiting example, the opening $\alpha_1$ degree of the gas valve VG (point 1 in FIG. 18), univocally corresponds to a "point 2" on the known and predetermined characteristic curve of the gas valve VG and, as a consequence, a corresponding value of the air flow $Q_{AIR}$ (represented by "point 3" in the abscissa) necessary to keep constant the titre of the air-gas mixture.

This air flow $Q_{AIR}$ to be supplied to the burner BRNi corresponds to a "point 4" on the known characteristic curve K of the air injector UG; the rotation speed of the fan V shall be, therefore, that of its characteristic curve passing by said "point 4" that defines the intersection with a characteristic curve of the fan V, representative of a predetermined rotation speed "n". This number of revolutions "n" of the fan V ($n_4$ in the example) corresponds, lastly, to a predetermined value of the operating pressure DP to be ensured to the air nozzle UG.

This simple example to show a first possible regulation method of the single burner BRNi of a hob 400 so as to always ensure a perfectly premixed combustion as the thermal power required by the user U varies.

It is noted that, according to this configuration of the invention, it is not necessary to provide for the use of pressure sensors for regulating the power of the burner 1, the manufacturer having mappings available of the characteristic curves of the gas valve VG and air injector UG; under these conditions it is therefore sufficient that the fan V is able to provide a tachometric signal to the control unit CMD of the hob 400.

Furthermore, the opening α degree of the gas valve VG may be advantageously transmitted to the same control unit CMD by means of known transducers TD integrated to said gas valve VG and the relative known transmission lines L0.

It is not necessary to dwell on other wirings L1, L2, L3 shown in FIG. 17 being them well known to the man skilled in the art; it is herein sufficient to specify that the line L1 connects the motor V0 of the fan V to the control electronics CMD while line L2 and L3 command, respectively, an igniter IGN of the burner BRNi and the respective flame detector FD. Finally, reference numeral L4 denotes the power line of the fan V also managed by the control electronics CMD.

Far more complex is instead the underlying logic of thermal power regulation of each burner BRNi, when a single fan V, pressurising the above mentioned compartment 405 inside the hob 400, supplies combustion air for all said burners BRNi (preceded by a special shut-off valve), generally different from each other.

In fact, the rotation speed "n" of the single fan V, may be exceeding or inappropriate for some burners BRNi of the hob 400; these may, therefore, move away from a substantially premixed operating condition with STC titre of the mixture.

What described below, will therefore adhere to the solution of "centralised" regulation of the air flow $Q_{AIR}$ to be supplied to each burner BRNi of a hob 400, previously discussed in a very general form.

Although all that will be said can be referred to hobs 400 comprising any number of burners BRNi, reference shall be made to a hob 400 equipped with only four burners BRNi (Z=4) in order to facilitate the understanding; in the example under consideration they are:

all different from each other, served, as already mentioned, by a single fan V that pressurises the compartment 405 of the same hob 400, the air injectors UG whereof are, in fact, parallel to each other because subject to the same upstream-downstream pressure drop.

With four (Z=4) burners BRNi the possible combinations C of simultaneously active burners C (indicated with the symbol "1") and/or switched off (indicated with the symbol "0") are in a number of 16 and summarised in the mapping of FIG. 21*a*, storable in the control unit CMD of the hob 400 by the manufacturer.

Considering a portion of the pressurised compartment 405 defined between the inlet section of the fan V and one or more outlet sections consisting of the open nozzles UG, it is possible to define for each corresponding combination C, as is known from the laws of fluid dynamics of passive components, a single corresponding "flow-pressure" characteristic curve KKn that in the graph of FIG. 19 is simplified by a parabolic type relation (of course, the typical characteristic curve of the situation with all the burners turned off is a degenerate parabolic curve that coincides with the ordinate of the graph).

Moreover, for each burner BRNi it is possible to attribute a stoichiometric titre STC to a power level thereof, that hereinafter will be called "target" level TGT, close to the nominal one.

Preferably, said target power level TGT is at 85% of the nominal power of the burner BRNi. However, it is possible to provide that the titre of the air-gas mixture to the burner BRNi is acceptably close to the stoichiometric ratio STC and thus "substantially stoichiometric STC", also in a neighbourhood of such target power level TGT, i.e. even by narrowing its modulation range, for example, by a +/−15% (although this inevitably corresponds to a reduction of the modulation ratio Y). In other words it is possible to modulate the opening α degree of the gas valve VG of the burner BRNi between a minimum value $\alpha_{min}$ equal to 70% and a maximum value $a_{max}$ equal to 100% while ensuring a stoichiometric STC or "substantially stoichiometric" STC titre of the air-gas mixture (and thus premixed flames).

By doing so, at each combination C also corresponds a unique value of the operating pressure DP(C) that ensures the exact supply of combustion air $Q_{AIR}$ to all the burners BRNi of the hob 400 simultaneously turned on and a single corresponding rotation speed n(C) of the fan V, obtaining a stoichiometric STC (or substantially stoichiometric STC) titre, regardless of the regulation of the opening α degree of the gas valve VG of each burner BRNi.

In general, all possible combinations C of an indefinite number of simultaneously active burners BRNi are storable in memory means of the above if said combinations C are in a finite number, i.e. if only a finite number of power levels are possible for each burner BRNi. Alternatively, when for one or more burners BRNi a continuous variation of their power level is possible, the control unit CMD may be provided with calculation means of said operating pressure DP(C), just mentioned.

In this way it is ensured that said burners 1 always operate within the premixed combustion condition.

Such operation of the entire hob 400 is summarised in the graph in FIG. 19, suitably and further simplified by providing for burners BRNi all identical to each other so as to reduce to five the number of combinations C of four burners BRNi from all off to all on (so as to reduce the number of characteristic curves that would make it substantially illegible).

In this case (burners identical to each other), therefore, a single characteristic curve KKn=KKA is identified for all the configurations involving only one active burner BRNi as well as unique characteristic curves KKB and KKC are identified for all representative configurations, respectively, of two or three simultaneously active burners BRNi; finally, a curve KKD for the single combination that provides for all active burners BRNi is identified. A mapping corresponding to this situation has not been provided, for simplicity, in the annexed figures; reference shall be therefore made, as anticipated, only to the graph of FIG. 19.

It has been found, therefore, that the (e.g. electronic) control unit CMD of the hob 400, once the simultaneously active burners BRNi are detected, is capable of identifying the air flow $Q_{AIR}$ and the relative operating pressure DP ensuring, regardless of the opening degree $\alpha_{min}<\alpha<a_{max}$ of the gas valve VG, a stoichiometric STC or almost stoichiometric STC titre for the air-gas mixture substantially in each burner BRNi.

For example, in FIG. 19, the combination C=3 (whereto the characteristic curve KKB corresponds), corresponding to the case in which only two of the four burners BRNi defining the hob 400 are on, will correspond to an air flow $Q_{AIR}=Q_2$ to be supplied to all the active burners BRNi and a corresponding operating pressure DP2 ensured by the fan V, operating at a rotation speed $n_2$.

At this point further evolutions and methods for systems definable as "almost premix" shall be analysed.

It is known that by further extending the modulation range of the burners BRNi, the titre of the air-gas mixture obtained varies as the fuel gas flow $Q_{GAS}$ provided by the gas valve VG, i.e. according to the power level required by the user U as a function of its opening $\alpha$ degree; below the target power level TGT, the mixture will be "leaner" (i.e. with more abundant excess of air) while above it will be richer in gas.

To expand the modulation ratio Y it is therefore possible to provide for the following variants.

Let us consider, without any limiting intent, a hob 400 comprising three simultaneously active burners BRNi, all different from each other and each regulated to its own thermal power, different from the target one TGT; such configuration may be obtained by setting a different opening $\alpha_i$ degree of the gas valve VG for each active burner BRNi, different from that defining the target power level TGT and therefore complying with the following relation: $\alpha_{min}<\alpha_{iMAX}$, with $\alpha_i\neq\alpha_{i_TGT}$ (i=1; 2; 3).

Each combination of simultaneously active burners BRNi, as already seen with reference to the preceding case, corresponds to:

- a predetermined characteristic curve $KK_i$ of the relative air nozzles UG
- corresponding values of the operating pressure DP of the compartment 405 of the hob 400, and
- corresponding speeds of the fan V that pressurises said compartment 405. In the $Q_{AIR}$-DP graph schematised in FIG. 20, for example the burners BRN1 and BRN3 have been regulated to a power higher than the target one TGT while the burner BRN2 to a lower power.

This means that by acting on the relative knob/push-button panel, the user U has set:

- an opening $\alpha_1$ degree and $\alpha_3$ of the gas valves VG of the respective burners BRN1 and BRN3 higher than that $\alpha_{tgt}$ adapted to ensure the target power level TGT ($\alpha_1>\alpha_{1_TGT}$; $\alpha_3>\alpha_{3_TGT}$),
- a lower opening $\alpha_2$ degree for the burner BRN2 ($\alpha_2<\alpha_{2_TGT}$).

That is, each burner BRNi, would work subjected to a proper and specific operating pressure $DP\alpha_i$ obtained through a corresponding rotation speed $n(\alpha_i)$ of the single fan V, different from the "target" one $DP_{tgt}$, (corresponding to a "target" rotation speed $n_{tgt}$ of the fan V and inferable from a mapping totally similar to that shown in FIG. 21*a*) that on the contrary would ensure, as seen, a premix combustion (e.g., the burner BRN1 should work at a pressure $DP\alpha_1$ while the fan V should operate at a rotation speed $n\alpha_1$, thereby similarly for the burners BRN2 and BRN3).

Under these conditions, therefore, each burner BRNi (in the example, BRN1, BRN2, BRN3) would not ensure a premix combustion.

In such case the control unit CMD of the hob 400 intervenes that:

- being known the configuration of simultaneously active burners BRNi through the detection of the status of the shut-off valves (not shown in the annexed Figs.) that precede the air nozzles UG,
- being known the angular positions $\alpha_i$ of the gas valves VG (which are able, therefore, to transmit their position to said control CMD through, by way of a non-limiting example, suitable electric signals that run through special and dedicated lines L0; e.g., see 26 and/or 27 and/or 28),
- being known the target rotation speed $n_{tgt}$ of the fan V (detectable from the tachometric signal that said fan V, as already anticipated, is able to generate and send through a dedicated data line; e.g., see reference L1 in FIG. 26 and/or 27 and/or 28),
- having received the signals from the flame detectors FDi (line L3 in FIG. 26 and/or 27 and/or 28), recalculates a new operating pressure $DP_{act}$ to which univocally corresponds a new rotation speed $n_{act}$ of the fan V and a consequent combustion air flow $Q_{act}$.

More precisely, this pressure $DP_{act}$ is intermediate to the single pressures $DP\alpha_i$ that each active burner BRNi should have; preferably it can be advantageously calculated as a weighted average:

$$DP_{ACT}=[(b1*DP\alpha_1+b2*DP\alpha_2+\ldots+b_k*DP\alpha_i+\ldots+bC*DP\alpha_C)/C]$$

where the various weights "$b_k$" can be freely chosen and optimized by the manufacturer of the hob 400, e.g., by attributing increasing weights based on the sizes of said burners BRNi; in this way, the burners BRNi that produce more power will also be those closer to a fully premixed operation.

Although less precise and efficient, obviously nothing prevents the possibility of calculating said pressure $DP_{ACT}$ as an arithmetic average of the single pressures $DP\alpha_i$ that each active burner BRNi should have.

Obviously, in all the cases of single active burner BRNi, this regulation method ensures a perfectly premixed combustion.

Of course, the best results of "almost-premix" systems are achieved with the regulation of the stoichiometric titre STC of the air-gas mixture with a target power level TGT comprised between 70% and 100% of the maximum power of the burner BRNi, previously seen, and with burners all identical to each other.

It is noted that with such regulation the risk of the well known backfire is inherently annulled since the output speeds from the slots 217 of each burner BRNi are systematically higher than the respective speeds of the flame front.

Moreover, a further consequence of this system is that the flames are systematically "detached" from the flame spreader 218, thus avoiding high operating temperatures typical of the conventional burners regulated to the minimum power.

Starting from the situation illustrated with reference to the graph of FIG. 20, wishing to further extend the modulation range of the burners BRNi of a hob 400, the regulation method, of the "centralised" type, just described will produce the proportional departures from the premix condition and a consequent greater imprecision on the control of the actual titre of the air-gas mixture of each burner BRNi.

In practice, as the modulation ratio Y increases a departure from the respective premix conditions for each burner BRNi is achieved.

This problem is overcome according to at least the variant of the invention of FIG. 22. According to this variant, for each burner BRNi it is possible to further discretize the possible levels of air flow $Q_{AIR}$ to be supplied as a function of the opening $\alpha_i$ degree of the corresponding gas valve VG, achieving a "fine regulation" of their power.

This may be achieved by providing more independent inlets for the combustion air and/or more valves (or "multi-way" valves) supplying one or more inlets for the air.

According to a variant, each burner BRNi may be preferably provided, e.g., with a plurality of air injectors each provided with the relative UGi and proceeded by the respective solenoid shut-off valve (not shown).

Preferably, said air and/or gas valves may be advantageously made through known valves of the "multi-way" type with sequential enabling of the outlets (whereon it is not necessary to dwell being them well known to the man skilled in the art).

Summarizing, said chocking may be achieved by providing for each burner BRNi the alternative use of:

more air nozzles UGi, each with different diameters;

multi-way valve;

In the example of FIG. 22, without any limiting intent, each burner BRNi of the hob 400 may preferably comprise two air nozzles, UG1, UG2, of different sizes (and a single gas injector). For description continuity and to make it possible, as will be seen, a comparison among the multiple variants of the invention, reference shall be made again to a hob 400 comprising only four burners BRNi.

By continuously increasing the thermal power of each burner BRNi, that is, by varying the opening $\alpha_i$ degree of the relative gas valve VG between a $\alpha_{imin}$ and a maximum $\alpha_{imax}$ value, the control unit CMD (e.g., of the electronic type) will act in such a way as to enable in succession: at the beginning (i.e, at low power) the smaller air injector; as the required thermal power increases it will be disabled to allow the activation of the second injector (the larger one); finally, approaching to the maximum thermal power of the burner BRNi, also the first air injector will be added, by enabling it again.

In this way the regulation range of the opening $\alpha_i$ degree of the gas valve VG of each burner BRNi is fractionable into three segments (or "steps") definable as follows:

$$\alpha_{i_min}<\alpha_i<\alpha_{i_Low};$$

$$\alpha_{i_Low}<\alpha_i<\alpha_{i_Med}$$

$$\alpha_{i_Med}<\alpha_i<\alpha_{i_MAX}$$

As a consequence, the mapping of the configurations of the hob 400, pre-loadable and manageable from the control unit CMD, changes as shown in FIG. 21*b*; in practice, if with reference to hobs 400 comprising a plurality of burners BRNi provided with only one gas valve VG and an air nozzle UG (e.g., see FIGS. 15, 16) sixteen different combinations C of simultaneously active and/or off burners were identified, now with the configuration of the burner BRNi just described said combinations become, as obvious, 256.

Also in this case, therefore, each configuration C descriptive of the combination of simultaneously active burners BRNi of the hob 400 and of the thermal power required (that may be evaluated as a function of the opening $\alpha_i$ degree of the single gas valve VG) shall univocally correspond to a combination of enabled air nozzles UGi, a characteristic curve KK(C), an optimum operating pressure DP(C) and a corresponding rotation speed n(C), said configuration C being detectable by the control unit CMD of the hob 400, substantially in the manners already said above with reference to other construction variants.

According to a further variant of the invention it is possible to apply the concept of discrete chocking of the combustion air just described above to the regulation of the fuel gas flow; that is, it is possible to provide a variant according to which the burners BRNi of a hob 400 work systematically in the premixed combustion condition with discrete levels of regulation of their thermal power.

An example of said burners BRNi is shown in FIG. 23.

Without any limiting intent, said burners BRNi comprise two air nozzles UG1, UG2 and two gas injectors 211*a*, 211*b*, each of which is preceded, as usual, by its own ON/OFF shut-off solenoid valve (not shown).

In FIG. 23, said gas injectors 211*a*, 211*b* are preferably shown constrained to the cup 200 of the burner BRN1 (e.g., by screwing) the one substantially orthogonal to the other according to the configuration that optimises the mixing with the combustion air; without minimising the generality of the invention, nothing prevents, obviously, to arrange and direct said gas injectors 211*a*, 211*b* in a different way, for example opposite.

Although not clearly visible in the figure, the two gas injectors 211*a*, 211*b* (like the air-nozzles) have suitably different diameters so as to regulate the supply of fuel gas to the burner BRNi solely through their three possible opening combinations (enabling); this allows to eliminate the gas regulation valve VG (essential for the continuous regulation illustrated with reference to the previous variants) in favour of a perfectly premixed burner BRNi with four power states.

More precisely, the burner BRNi may pass, through the action on a specific selector (which may replace the standard rotary valve), from its OFF level, when both injectors are disabled, to a minimum power level ($P_{min}$) when only the smaller-diameter gas injector is enabled, to an average power level ($P_{Med}$) corresponding to the activation of the gas injector only with the greater diameter and to a maximum power level ($P_{Max}$) when both gas injectors are operating simultaneously.

Since each combination C of enabled gas nozzles 211*a*, 211*b* corresponds to one and only one combination of open air injectors UGi, the mapping of the configurations of the states of the hob 400, schematised in FIG. 21*c*, may be said to be substantially unchanged compared to that relative to the burners BRNi of FIG. 22 previously discussed (and to which reference is made for any further explanation and detail).

Even in this case, therefore, the control unit CMD, once said mapping is known and having detected which burners BRNi have been enabled by the user U and at what power, is able to regulate the rotation speed $n_i$ of the fan V accordingly by defining the pressure DP of the pressurised compartment 405 of the hob 400 and the air flow $Q_{AIR}$ to be supplied so as to ensure a substantially premixed combustion to each burner BRNi.

It is clear that in the practical embodiment of the invention numerous modifications may be provided, all falling within the same inventive concept.

For example, nothing prevents the possibility of implementing "stoichiometric mixers MS" to the ventilated hob 400, of the type illustrated in FIG. 29 and based on similar solutions used in the field of household boilers. That is, according to this configuration is possible to replace the mixing chamber inside the cup 200 of the burner BRNi, with a primary gas ejector $EJ_p$ directly keyed on a mixing Venturi pipe 10 which is crossed by the combustion air coming from the fan V that pressurises the compartment 405 of said hob 400 (not shown in FIG. 29); it is therefore possible to modulate gas and air to the Venturi with a single valve body.

In this way, the formation of the air-gas mixture goes through two consequential steps; when the fuel gas flows, through the nozzle 211 of a gas injector (not explicitly shown) in the primary ejector $EJ_p$ drags a certain air flow therein shown in FIG. 29 as AIR A forming a flow of mixture rich in gas (shown as MIX A) that subsequently expands in the sealed chamber 17 about the Venturi groove, where it is recalled by the depression residing therein.

At this point, the mixture MIX A is suitably diluted by an air flow AIR B in input in said mixing Venturi so as to ensure a stoichiometric (or substantially stoichiometric) titre STC to the homogeneous mixture MIX B in output from the device.

Although not shown in the reference FIG. 28, the outlet section 150 of the mixture MIX B of said stoichiometric mixer MS may be connected directly to the cup of the burner BRNi that, therefore, does not need those inner mixing and homogenisation grids 205.

Further changes may be made to the versions of burners BRNi comprising one or more air UG and/or gas 211 nozzles (shown, for example, in FIGS. 15, 22, 23) presented as removable components (e.g, being simply screwed to the cup 200 of the same burner BRNi).

As shown in FIG. 24, calibrated openings 201.*a*, 201.*b* (of different diameters) are then made directly on the cup (200) body of the burner BRNi, each respectively served by special fuel gas or combustion air conduits 202, 203, equipped with relative shut-off solenoid valves $EV_1$, $EV_2$ (that may be positioned anywhere between the cup 200 and a gas and air supply manifold, not shown).

According to the variant of FIG. 25, instead, the cup 200 body of the burner BRNi may further comprise chambers 204, 205 (e.g. in a number of two) outside that supply combustion air or fuel gas to those calibrated openings 201 obtained directly, as mentioned, on the same cup 200.

For description simplicity and in order to distinguish them, said chambers 204, 205 shall be referred to as "air chamber 204" and "gas chamber 205", respectively.

The shut-off solenoid valves may be directly keyed on the same chambers 204, 205 so as to enable directly the air and gas injectors UGi, 211.

Reference numerals 202, 203 again indicate the fuel gas and combustion air supply conduits, respectively.

Such variant allows to simplify the construction of the air and fuel gas supply circuits reducing the number of conduits required.

FIG. 25 also shows the control lines LC of the gas and air solenoid valves the enabling and/or disabling whereof is managed by means of electromechanical/electronic push-button panels (as shown) either analogue or digital.

With reference to FIG. 26 a possible constructive configuration for a ventilated hob 400 is shown, comprising a plurality of burners BRNi of the type just illustrated above.

The attention is drawn to the fact that, according to this version:

- a single air channel 407, pressurised by the fan V located upstream, supplies all the supply conduits 203 of the air chambers 204 of each burner BRNi,
- a single gas channel 408 supplies the supply conduits 202 of all the relative gas chambers 205 of the same burner BRNi, said air 407 and gas 408 channels being, therefore, components that are distinct and separate to each other.

Of course, it is preferable that the sections of said air and gas channels 407, 408 are >> than the sections of the single supply conduits 202, 203, minimising the load losses.

Of course, nothing prevents the possibility of providing a further variant of the hob 400 just described, by providing a gas and combustion air supply system of the "tube-in-tube" type (not necessarily coaxial), the inner tube 408 being capable of supplying fuel gas directly to each supply conduit 202 of the gas chambers 205 of each burner BRNi and the outer tube 407 supplying with combustion air the respective air conduits 203 for the above air chambers 204 (see FIG. 27).

As they are well known to the man skilled in the art and/or covered in other patent applications in the name of the same Applicant, it is not necessary to dwell on the characteristics and functionalities of the various wirings, of the push-button panel and/or of the safety valves, in any case shown and classified in said variants of FIG. 26, 27.

It is clear that according to these variants the air-gas mixing is carried out and completed inside the cup 200 of each burner BRNi.

Nothing prevents, obviously, the possibility of carrying out such mixing upstream of each burner BRNi, as shown in FIG. 28.

According to this variant, the air-gas mixture (premixed or substantially premixed) is in fact obtained inside a mixing compartment 409, inferiorly communicating directly with the air channel 407 of the above sealed circuit (CAL 405, 407) and the gas channel 408, and subsequently supplied to the burner BRNi by means of a suitable pipe 410.

More precisely, an air injector UG communicating with the air channel 407 and at least one gas injector 211 in turn communicating with the relative gas channel 408 insists on said mixing compartment 409, their activation allowing the input of said combustion air and fuel gas for the creation of the mixture intended for the burner BRNi.

Such constructional solution is easily achievable by providing, therefore, channels 407, 408 substantially close to each other.

According to a constructive variant, not shown in the annexed figures, said channels 407, 408, may for example be substantially adjacent and parallel to each other.

However, preferably, said channels 407, 408 are concentric (not necessary coaxial) as shown in FIG. 28, defining, as already seen, an air-gas supply system of the "tube-in-tube" type. Without any limiting intent, in this latter preferred variant said at least one air and gas injector may be concentric to each other, with the second inside the first, so as to define a single component (hereinafter referred to as "concentric injector"):

- preferably obtained directly on the outer wall of said "tube-in-tube" supply system
- provided with a single shutter capable of being actuated, for example, through an electromechanical actuator, to allow the simultaneous input of air and fuel gas inside said mixing chamber.

It should be noted that in FIG. 28, by way of a non-limiting example and without any limiting intent, a mixing compartment is shown comprising two of said "air-gas concentric injectors" so as to substantially recreate that situation (and the relevant advantages and consequences) already describes with reference to burner BRNi of FIG. 23 (to which reference shall be made).

In this regard, it should be noted that for each burner BRNi said two "concentric injectors" have different sizes (one with smaller air and gas inlet sections $d_{Li}$ and $DA_{Li}$, the other with oversize sections $d_{Hi}$ and $DA_{Hi}$), each provided with its shutter.

Therefore, by combining alternatively the openings of the shutters of said pair of "concentric injectors" of the burner BRNi different power levels may be obtained as already widely described.

In conclusion, it is clear that with the hobs 400 and relative burners BRNi according to multiple variants of the invention all the stated objects are achieved in addition to ensuring further multiple advantages.

More precisely, besides those from time to time referred to during this description, it is possible to provide active devices for moving and supplying combustion air (such as fans V) that ensure fully premixed flames and/or with excess of air to the burners BRNi of a hob 400, according to the methods previously described and without the need of requiring the input of secondary air, reaching higher modulation ratios Y than those currently obtainable.

The need of replacing the gas injector in order to manage different fuel gases is also avoided: it is sufficient to change the regulation "mapping" of the fan V to take into account the different density and calorific value of the new gas: e.g. switching from methane (20 mbar) to 1 pg (30 mbar), keeping the gas and air openings unchanged, it will be necessary to significantly increase the supply of air with consequent increase (over 50%) of the nominal powers of all the BRNi(s). In the worst case it might be necessary to replace only the "flame spreader" 218 of the burner BRNi due to the different outflow rates of the air-gas mixture from the respective "slots" 217.

In conclusion, the multiple variants of hob 400 of the invention, described in the present description, may be thus summarised and generalised.

Each burner BRNi of the hob 400 comprises means adapted to regulate the air flow $Q_{AIR}$ in a suitable way in order to ensure that amount sufficient to have an air-gas mixture with a substantially constant titre, in particular substantially stoichiometric STC, regardless of the power set in the burner BRNi itself.

This implies the provision of one or more fans V that ensure an air pressure $Q_{AIR}$ higher than the ambient one.

In a first general variant, a fan V ensures an overpressure in the plenum 405 of the hob 400 that, taking in to account the thermal powers set by the user on each burner BRNi, ensures to each of them an air flow substantially equal to that necessary to ensure an air-gas mixture with a stoichiometric or substantially stoichiometric ratio STC.

To this it could be added the fact that at the air inlet section in each burner BRNi there are further means for a "fine regulation" of the air flows.

According to another basic variant, the fan V ensures a pressure substantially constant and exceeding that maximum necessary while said "fine regulation" is provided for each burner BRNi.

According to this last variant, finally, also said fan V may vary the operating pressure as a function of that maximum currently provided in the various burners BRNi.

Finally, it should be noted that some variants described in this description (see, for example, the air flows mechanical regulation means of FIG. 10 and/or 12) may be advantageously used even in hobs comprising only one burner or having burners each supplied by it dedicated fan, therefore constituting also a specific object of a parallel and concurrent patent application.

The invention claimed is:

1. A ventilated hob comprising a motor-driven fan adapted to provide high pressure air to two or more burners thereof, each of said two or more burners at least comprising:

a fuel flow supply and regulating system configured to supply and regulate a flow of fuel gas in an input into each of said two or more burners and supplied by a gas channel, said fuel flow supply and regulating system comprising at least one gas injector, a combustion air supply system configured to regulate a flow of combustion air in the input into each of said two or more burners, said combustion air, supplied from a sealed circuit, being capable of mixing with said fuel gas, said combustion air supply system comprising of at least one air nozzle having a calibrated and fixed opening, an electronic control unit for controlling said air flow and including a memory, wherein the electronic control unit is configured such that said air flow varies as a function of said flow of fuel gas in input into each of said two or more burners so as to ensure a gas-air mixture with a stoichiometric or substantially stoichiometric ratio without the need of input of secondary air from outside, wherein said variation of said air flow being obtained by varying the pressure of the combustion air in said sealed circuit inside said hob, said fan being configured to regulate its rotation speed to determine the required air pressure, said regulation of the air flow being centralised, wherein said electronic control unit is configured to detect the configuration of simultaneously active burners, wherein said electronic control unit is configured to detect an opening degree of the gas valves of each of said active burners, each of said opening degree corresponding to a specific operating pressure which also takes into account the characteristic curves of said combustion air supply system for supplying the said flow of combustion air, wherein said electronic control unit is configured to determine an operating pressure intermediate to the single pressures that each active burner should have, said intermediate operating pressure univocally corresponding to a rotation speed of said fan, said intermediate pressure being determined through mappings, loaded into the memory of said electronic control unit, of all possible combinations of simultaneously active burners according to all their possible power levels.

2. The ventilated hob according to claim 1, wherein each of said two or more burners further comprise shut-off valves of the flow of said combustion air.

3. The ventilated hob according to claim 2, wherein said centralised regulation of said flow of combustion air may also be associated with a localised regulation, said flow of combustion air being able to be regulated through variations of a passage section of the air of said combustion air supply system.

4. The ventilated hob according to claim 2, wherein said shut-off valves are located upstream of said combustion air supply system.

5. The ventilated hob according to claim 1, wherein the value of said intermediate pressure is the weighted average of said single pressures that each active burner) should have.

6. The ventilated hob according to claim 1, wherein said at least one air nozzle consists of two air nozzles, said two nozzles having different diameters and discretizing the levels of said air flow to be supplied to each of said two or more burners as a function of the opening degree of the corresponding gas valve.

7. The ventilated hob according to claim 1, wherein said the combustion air supply system configured to regulate the flow of fuel gas associated with each of said two or more burners may include two gas injectors, said gas injectors having different diameters and discretizing the levels of thermal power of each burner.

8. The ventilated hob according to claim 1, wherein said at least one air nozzle and said at least one corresponding gas injector are constrained on a cup of each of said two or more burners which acts as an air-gas mixing chamber.

9. The ventilated hob according to claim 1, wherein said at least one air nozzle and said at least one corresponding gas injector are constrained on a cup of each of said two or more burners facing each other, said air nozzle and gas injector being constrained to the opposite sides and of said cup, respectively.

10. The ventilated hob according to claim 9, wherein said at least one air nozzle and said at least one corresponding gas injector are constrained on the same side of said cup concentrically to each other, said at least one air nozzle being arranged externally to said corresponding at least one gas injector.

11. The ventilated hob according to claim 10, wherein said at least one air nozzle and said at least one corresponding gas injector concentric to each other may be coaxial.

12. The ventilated hob according to claim 9, wherein said at least one air nozzle and said at least one corresponding gas injector are constrained on the same side of said cup alongside each other.

13. The ventilated hob according to claim 1, wherein said at least one air nozzle and said at least one corresponding gas injector facing each other are mutually misaligned.

14. The ventilated hob according to claim 1, wherein at least two perforated grids, one on top of the other, may be provided inside a cup of each of said two or more burners, able to improve and homogenize the air-gas mixing, said at least two perforated grids being able to differ from each other by number and/or shape and/or size of their holes.

15. The ventilated hob according to claim 1, wherein said at least one air nozzle and said at least one corresponding gas injector comprise calibrated openings obtained on the sides of a cup of each of said two or more burners.

16. The ventilated hob according to claim 15, wherein the body of said cup may externally comprise air and gas chambers for said combustion air and fuel gas.

17. The ventilated hob according to claim 1, wherein said at least one air nozzle and said at least one corresponding gas injector are constrained to a compartment, which acts as an air-gas mixing chamber, located upstream of each of said two or more burners of said hob, said mixing compartment being:

inferiorly communicating with an air supply channel of said sealed circuit and the gas channel, said channels, being substantially close to each other, and connected to each of said two or more burners by means of a suitable pipe).

18. The ventilated hob according to claim 1, wherein an air supply channel and said gas channel are concentric to each other according to a tube-in-tube configuration.

* * * * *